US005798779A

United States Patent [19]

Nakayasu et al.

[11] Patent Number: 5,798,779

[45] Date of Patent: Aug. 25, 1998

[54] ULTRASONIC PRINTING APPARATUS AND METHOD IN WHICH THE PHASES OF THE ULTRASONIC OSCILLATORS ARE CONTROLLED TO PREVENT UNWANTED PHASE CANCELLATIONS

[75] Inventors: Hirofumi Nakayasu; Yoshihiko Kaiju; Kotaro Kameya; Takaki Shimura; Atsuo Iida, all of Kawasaki; Toshifumi Tanida, Inagi, all of Japan

[73] Assignee: Fujitsu Limited, Kawasaki, Japan

[21] Appl. No.: 557,833

[22] Filed: Nov. 14, 1995

[30] Foreign Application Priority Data

Mar. 16, 1995 [JP] Japan ..... 7-057818

[51] Int. Cl.[6] ..... B41J 2/04

[52] U.S. Cl. ..... 347/46; 347/7; 347/13; 347/15; 347/89

[58] Field of Search ..... 347/6, 7, 9–15, 347/22, 27, 29, 33, 44, 46, 48, 94, 68, 89

[56] References Cited

U.S. PATENT DOCUMENTS 4,046,073 9/1977 Mitchell et al. ..... 101/489
4,600,928 7/1986 Braun et al. ..... 347/27
4,895,158 1/1990 Kawabuchi et al. ..... 128/662.06
5,200,764 4/1993 Nagasawa ..... 346/105
5,612,723 3/1997 Shimura et al. ..... 347/46

*Primary Examiner*—Adolf Berhane
*Attorney, Agent, or Firm*—Armstrong, Westerman, Hattori, McLeland & Naughton

[57] ABSTRACT

An ultrasonic printing method by which recording of a high resolution can be achieved. In the ultrasonic printing method, some or all of a plurality of ultrasonic oscillators are selectively driven in such phases that a difference in phase at a predetermined point between a reference ultrasonic wave from one of the selected ultrasonic oscillators and another ultrasonic wave from any other one of the selected ultrasonic oscillators is equal to or less than one-fourth a wavelength of the ultrasonic waves in a transmission medium for the ultrasonic waves from the selected ultrasonic waves to the predetermined point. The ultrasonic printing method can be applied to various printing apparatus for which recording of a high resolution is required.

72 Claims, 31 Drawing Sheets

ULTRASONIC PRINTING APPARATUS AND METHOD IN WHICH THE PHASES OF THE ULTRASONIC OSCILLATORS ARE CONTROLLED TO PREVENT UNWANTED PHASE CANCELLATIONS

BACKGROUND OF THE INVENTION

1. Field of the Invention

The present invention relates to an ultrasonic printing method and an ultrasonic printing apparatus wherein converging ultrasonic waves are emitted to discharge ink in the proximity of a converging point of the ultrasonic waves as an ink drop to apply the ink to a recording medium such as paper in order to record a large number of ink dots on the recording medium and further to a method of forming an acoustic lens suitable for use with such ultrasonic printing.

2. Description of the Related Art

The popularity of ink jet printers wherein fine particles of ink (ink drops) are caused to flow directly to a recording medium such as paper has spread rapidly in recent years due to their advantages in high speed printing, low noise, less restriction to a recording medium and facility in color printing.

A nozzle of an ink jet head of an ink jet printer of the type mentioned often suffers from a problem such that, due to an increase in viscosity of ink during stopping of printing or due to presence of an air bubble entering the nozzle during printing, ink becomes likely to leave the nozzle less smoothly when printing is started, causing a miss of an ink dot in printing, or ink becomes solid and causes choking of the nozzle, which may render the use of the entire recording head impossible.

In order to eliminate the trouble, various backup operations are employed including capping wherein a nozzle is capped, when printing is not performed, to prevent evaporation of water from ink, wiping wherein an excessive amount of ink sticking to a nozzle is wiped off, and suction purge wherein, before a power source is made available or when necessary, a nozzle is capped with an ink suction cap to remove ink having an increased viscosity or ink in which an air bubble is contained. However, the ink jet printers have a subject to be solved in that, in order to allow the printer to perform a backup operation, the printer is complicated in structure and requires an increased cost.

Further, part of ink having left previously from a nozzle sometimes sticks to an edge of the hole of the nozzle to soil the nozzle or become rigid and changes the jetting direction of succeeding ink thereby displacing a dot of ink to be printed away from a correct position. Consequently, ink jet printers have another subject to be solved in that a good printing result cannot be obtained and, in color printing, a printing result does not have an intended hue.

Further, some of known ink jet printers are constructed such that an ink chamber and a nozzle are provided and the ink chamber is compressed by means of a piezoelectric element to force out ink through the nozzle, or ink is heated by means of a heater to force out the ink. However, the ink jet printers of the type just mentioned require much time to re-fill the nozzle chamber with ink and has a restriction in time until ink is jetted subsequently after ink is jetted once from the nozzle.

Meanwhile, with ink jet printers of the nozzle type, since the diameters of nozzles are fixed, the sizes of ink drops are the same and fixed in principle, and it is difficult to vary the printed dot size. Further, with ink jet printers of the nozzle type, since the entire head cannot be used any more if only one of nozzles of the head is choked with ink, a head of the throw-away type wherein a head and an ink tank are formed as a single unit is used in most cases. In this instance, since a consumable structure is used, ink jet printers of the nozzle type are disadvantageous in that an increased printing cost is required.

In order to solve those subjects described above, an inexpensive new printing system of a simple structure which does not include a nozzle and is free from choking of a nozzle is desired.

As one of printing systems which satisfy the demand, an ultrasonic printer or ultrasonic printing apparatus has been proposed in recent years. The ultrasonic printer is generally constructed to make use of a phenomenon in that, when ultrasonic waves are emitted focused at a free surface of liquid using acoustic lenses or like elements, a drop of the liquid runs out from the surface of the liquid, a drop of ink is discharged to print on a recording medium such as paper.

One of ultrasonic printers of the type mentioned, which is disclosed in U.S. Pat. No. 4,751,530, will be described subsequently with reference to FIGS. 45 and 46. FIG. 45 shows in perspective view a recording head of a common ultrasonic printer, and FIG. 46 shows in sectional view the recording head of FIG. 45 in a condition wherein it is disposed in ink liquid.

Referring first to FIG. 45, a plurality of spherically recessed acoustic lenses 12 are formed on the surface of an acoustic medium 10. An ultrasonic oscillator 14 is securely mounted on the rear face of the acoustic medium 10 in an opposing relationship to each of the acoustic lenses 12.

Referring now to FIG. 46, the acoustic medium 10 is disposed in ink 16, and the ultrasonic oscillators 14 are driven to generate ultrasonic waves. The ultrasonic waves thus generated propagate in the acoustic medium 10. Since the acoustic medium 10 is formed from a material in which a sound propagates at a speed higher than that in the ink 16, the ultrasonic waves having propagated in a the acoustic medium 10 are bent in direction at the positions of the acoustic lenses 12 so as to be converged to focal positions of the lenses 12 so that they are converged in the proximity of a free surface **16*a* of the ink 16. Consequently, fine particles of the ink (ink drops) are discharged from the free surface 16*a* of the ink 16** and stick to a recording medium to perform recording of dots of the ink.

It is to be noted that the ink drops thus discharged have a diameter substantially equal to the diameter of the spots of the converged ultrasonic waves, and when an ink drop sticks to the recording medium, the diameter of the dot is expanded to approximately twice the particle size of the ink drop.

FIG. 47 shows in schematic perspective view another general ultrasonic printer which is disclosed in U.S. Pat. No. 4,308,547. The ultrasonic printer shown in FIG. 47 is used to print bar codes.

Referring to FIG. 47, ink 22 in an ink reservoir 20 is transferred to an ink transportation belt 26 by a roller 24. The ink transportation belt 26 has an endless configuration and is circulated by and under the guidance of rollers 28. A plurality of ultrasonic oscillators 30 are disposed in the proximity of the center of an upper portion of the ink transportation belt 26.

Each of the ultrasonic oscillators 30 has an ultrasonic wave emission face in the form of a cylindrical concave face, and an acoustic medium 32 having a tapering thin end is mounted mounted on the cylindrical concave faces of the ultrasonic oscillators 30. If an ultrasonic wave is radiated from any one of the ultrasonic oscillators 30, since the ultrasonic wave emission faces of the ultrasonic oscillators 30 are each formed as a cylindrical concave face, the ultrasonic wave is converged toward a direction of the concave face. Consequently, a particle or drop of ink is discharged from the ink transportation belt 26. Then, such particles of ink pass through a slit 34 and stick to recording paper 36 to record a bar code on the recording paper 36.

However, the ultrasonic printing technique has not been established fully, and in order to realize ultrasonic printing, such various subjects as described below must be solved.

In the recording head of the ultrasonic printer shown in FIGS. 45 and 46, an ultrasonic oscillator 14 and an acoustic lens 12 are provided for each one dot, and because energy sufficient to discharge an ink drop must be supplied to each of the ultrasonic oscillators 14 and because each ultrasonic wave must be converged to a sufficiently small spot (of the diameter of, for example, approximately 0.03 mm) in order to achieve a high resolution, each of the ultrasonic oscillators 14 and each of the acoustic lenses 12 must be so shaped and dimensioned as to satisfy the requirements described above (for example, to the dimensions of 1 mm square and 1 mm in diameter).

However, they are apparently inconsistent to each other to arrange the ultrasonic oscillators 14 of 1 mm square and/or the acoustic lenses 12 of 1 mm in diameter per one dot and to realize a high resolution printer which records with the dot pitch of, for example, 0.06 mm.

In order to eliminate the inconsistency, another arrangement has been proposed wherein a plurality of (for example, 16) such recording heads as shown in FIG. 45 are arranged in a zigzag pattern to make the dot pitch smaller than the arrangement pitch of ultrasonic oscillators. However, where such a large number of recording heads are provided, the printer is increased in size as much and requires a considerable increase in cost. Therefore, the arrangement is not practical.

Also in the ultrasonic printer shown in FIG. 47, since each of the ultrasonic oscillators 30 must emit an ultrasonic wave having sufficient energy to cause an ink drop to be discharged, the ultrasonic oscillators 30 must be arranged at a considerably large pitch.

Thus, it a possible to increase the length (dimension in the leftward and rightward direction in FIG. 47) of each of the ultrasonic oscillators 30 so as to allow the ultrasonic oscillator 30 to emit an ultrasonic wave having sufficient energy while decreasing the arrangement pitch of the ultrasonic oscillators 30 as much. In this instance, however, since the diameter of the spot of an ultrasonic wave emitted from each of the ultrasonic oscillators 30 in the arrangement direction of the ultrasonic oscillator 30 relies upon the directivity of the ultrasonic wave, a decrease in arrangement pitch results in increase of the spot diameter.

Accordingly, while the ultrasonic printer shown in FIG. 47 can perform comparatively rough recording such as recording of a bar code, it cannot be applied to a high resolution printer of such a level as described above (a printer of the level wherein the dot pitch is approximately 0.06 mm).

Taking the situation described above into consideration, in order to allow recording of a high resolution, a further ultrasonic printing system called ultrasonic printing system of the phased array (linear array) type has been proposed and is disclosed, for example, in Japanese Patent Laid-Open Application No. Heisei 6-17657. Referring to FIG. 48, the ultrasonic printing system includes a plurality of ultrasonic oscillators 60 (60A). When one ink drop is to be discharged, some or all of the ultrasonic oscillators 60 are driven in two or more different phases so that phase-controlled ultrasonic waves are emitted from those ultrasonic oscillators 60 and converged to a predetermined point (for example, to a point 0 in FIG. 48).

It is to be noted that, in FIG. 48, reference numeral 210 denotes an acoustic medium (substrate) having the ultrasonic oscillators 60 (60A) mounted on a rear face thereof, 240 ink, and 240A a level of the ink 240.

When ultrasonic printing is performed with the ultrasonic printing system of the phased array type described above, if the number of different patterns of phase signals for driving the ultrasonic oscillators 60 is sufficiently great, then such a problem as will be described below little occurs. However, if it is attempted to drive the ultrasonic oscillators 60 with a small number of patterns of phase signals, then the energy (power) efficiency drops as described below.

In particular, if the phase of a phase signal which serves as a reference signal when the reference phase signal from one of the ultrasonic oscillators 60 arrives at the ink level 240A which is the free surface of the ink 240, that is, the phase of the reference phase signal at the position 0, is represented by zero, the phase of a phase signal emitted from any other ultrasonic oscillator 60 when it arrives at the position P on the ink level 240A is displaced a little from the phase of the reference phase signal.

If a case wherein the ultrasonic oscillators 60 are driven, for example, by a pattern of eight different phase signals (0°, 45°, 90°, 135°, 180°, 225°, 270° and 315°) is considered, then the magnitude in phase displacement is 22.5° (=45°/2) in the maximum. On the other hand, if another case wherein the ultrasonic oscillators 60 are driven, for example, by a pattern of four different phase signals (0°, 90°, 180° and 270°), then the magnitude in phase displacement is 45° in the maximum. Or, if a further case wherein the ultrasonic oscillators 60 are driven, for example, by a pattern of two different phase signals (0° and 180°), then the magnitude in phase displacement is 90° in the maximum. In this manner, if it is attempted to drive the ultrasonic oscillators 60 by a pattern of a small number of phase signals in this manner, then the magnitude in phase displacement is just as great.

As the magnitude in phase displacement increases, the phases of ultrasonic waves to converge to the ink level 240A are displaced from each other. The efficiency of each ultrasonic wave then is given by $\cos\theta$ in sound pressure level (here, $\theta$ is a phase angle from that of the reference phase signal). In particular, if the phase displacement amounts to 90°(quarter wavelength), then $\cos 90°=0$, and the efficiency is zero. In this instance, the ultrasonic wave emitted from an ultrasonic oscillator 60 does not contribute to discharging from the level of the ink. Further, if the phase displacement exceeds 90°, then the ultrasonic wave acts in a direction to partially cancel the reference phase signal. Consequently, roughly speaking, if the ultrasonic oscillators 60 are driven with a pattern of phase signals of two or more phases, the phase displacement does not become smaller than 90°.

However, strictly speaking, some of ultrasonic waves from an ultrasonic oscillator 60 may possibly exhibit a phase displacement less than 90° depending upon the position of the ultrasonic oscillator in the widthwise direction. When the width of an ultrasonic oscillator 60 is taken into consideration, the phase of an ultrasonic wave from the ultrasonic oscillator 60 when the ultrasonic wave arrives at the position 0 on the ink level 240A varies depending upon the position on the ultrasonic oscillator 60.

As seen in FIG. 48, the phase of a phase signal (ultrasonic wave) emitted from a point "a" on the ultrasonic oscillator 60A and arriving at the position 0 on the ink level 240A and the phase of another phase signal (ultrasonic wave) emitted from another point "b" on the ultrasonic oscillator 60A and arriving at the position 0 on the ink level 240A are different from each other. The difference between the phases increases as the distance of the ultrasonic oscillator from the ink jetting point increases. Accordingly, when the ultrasonic oscillators 60 (60A) are driven by a pattern of phase signals of two phases, even if the phase of the phase signal emitted from the central point c in the widthwise direction of the 60A, which is a piezoelectric element, is equal to or less than 90° (quarter wavelength), the phase of an ultrasonic wave emitted from the point "a" or "b" may possibly be greater than 90°.

The situation described above will be described in more detail below indicating particular values with reference to FIG. 48. It is assumed that, as seen in FIG. 48, the pitch of the ultrasonic oscillators 60 (60A) is 85 μm, the width of the ultrasonic oscillators 60 (60A) is 65 μm, the height of the ink 240 (the distance from the acoustic medium 210 to the ink level 240A) is 7.5 mm, and the number of those ultrasonic oscillators 60 (60A) which are to be driven at a time to discharge one ink dot is 101. Further, if the frequency of ultrasonic waves is 20 MHz and the sound velocity in the ink 240 is 1,500 m/sec, then the wavelength μ of ultrasonic waves in the ink 240 is 1,500/20=75 μm, and the quarter wavelength λ/4 is 18.75 μm.

For example, where one of the 101 ultrasonic oscillators 60 which is positioned at the center and makes a reference is denoted as 0th ultrasonic oscillator 60, the 50th ultrasonic oscillator 60A in the leftward direction is examined here. The ultrasonic oscillator 60A is spaced by 0.085×50=4.25 mm from the 0th ultrasonic oscillator 60 of the reference.

The distance from the central point "c" in the widthwise direction of the ultrasonic oscillator 60A to the ink drop discharging position of the ink level 240A (the position 0 just above the central position in the widthwise direction of the 0th ultrasonic oscillator 60 of the reference) is 8.6205 mm. This distance corresponds to 114.9396 times the wavelength λ, and this represents that 114.9396 waves are present in this distance.

Further, the distance from the central point in the widthwise direction of the 0th ultrasonic oscillator 60 to the ink drop discharging position 0 of the ink level 240A is 7.5 mm, and just 100 waves of the ultrasonic wave are present in this distance.

Accordingly, a wave from the 50th ultrasonic oscillator 60A is displaced in phase by 0.9396 wavelengths =−0.0604 wavelengths. In other words, when the ultrasonic oscillator 60A is driven by a pattern of phase signals of two phases, an ultrasonic wave emitted from the center of the ultrasonic oscillator 60A makes a signal which either has a phase difference of 0.4396 (=0.9396−0.5) wavelengths or has another phase difference of 0.9396 (=−0.0604) wavelengths with respect to a reference phase signal at a point of time when it arrives at the ink level 240A. Then, the 50th ultrasonic oscillator 60A is driven by a phase of 0.9396 (=−0.0604) wavelengths (because $|0.4396\lambda| > |-0.0604\lambda|$).

By the way, the distance 8.6205 mm mentioned above is a distance from the central point "c" in the widthwise direction of the ultrasonic oscillator 60A while the distance from the point "a" to the ink discharging point 0 is 8.6365 mm and corresponds to 115.1539 wavelengths and consequently the phase displacement at the ink discharging point 0 is 0.1539 wavelengths, but the distance from the point "b" to the ink discharging point 0 is 8.6045 mm and corresponds to 114.7266 wavelengths and consequently the phase displacement at the ink jetting point 0 is −0.2734 wavelengths. In this instance, an ultrasonic wave from the point "b" is displaced, at the ink discharging point 0, by more than a λ/4 wavelength from the reference ultrasonic wave, and consequently, the ultrasonic wave emitted from the point "b" does not contribute to discharging of an ink drop and rather cancels the phase of an ultrasonic wave or waves emitted from some other ultrasonic oscillators 60, disturbing discharging of an ink drop.

It is to be noted that, in the foregoing description in connection with FIG. 48, no description is given of transmission of an ultrasonic wave in the acoustic medium (substrate material) 210. If it is considered that, in the acoustic medium 210, an ultrasonic wave is transmitted as a parallel wave, then it is required only to subtract a propagation time in the ultrasonic wave in the acoustic medium 210. Accordingly, the results of calculation described above and results of calculation in which transmission of an ultrasonic wave in the acoustic medium 210 is taken into consideration are substantially equal to each other.

In this manner, the ultrasonic printing system of the phased array type has a subject to be solved in that, if it is attempted to drive the plurality of ultrasonic oscillators 60 (60A) with a pattern of a comparatively small number of phase signals, then the energy (electric power) efficiency drops very much and gives rise to a situation that discharging of an ink drop is disturbed.

In addition to the subjects described above, such various subjects to be solved as described in items (i) to (vi) below must be solved in order to realize ultrasonic printing.

(i) The frequency of an ultrasonic wave for discharging an ink drop is normally set to a resonance frequency based on a condition of ink, and by using the resonance frequency, an ink drop can be discharged with a high energy efficiency. However, if the condition (for example, the temperature) of the ink varies, also the resonance frequency varies. Consequently, depending upon the condition of the ink, the output energy which can be extracted as dynamic energy by way of an ultrasonic wave may decrease to such a degree that discharging of an ink drop is impossible.

(ii) In such a recording head (print head) 80 in a printer which employs an ultrasonic printing system of the phased array (linear array) type as shown in FIG. 49, a plurality of ultrasonic oscillators (refer to reference characters 60 and 60A in FIG. 48) are arranged in a straight line, and the recording head 80 is disposed such that the direction in which the ultrasonic oscillators are arranged is perpendicular to the direction of transportation of print paper 81 as a recording medium (that is, a paper feeding direction: refer to an arrow mark 82). When ultrasonic wave printing is performed by the ultrasonic printing system of the phased array type with the recording head 80 arranged in such a manner as just described, since adjacent dots are successively recorded on the print paper 81 while the print paper 81 is moved at a predetermined transportation speed, even if it is attempted to draw a straight line (for example, a line of a frame of a table) in a dot line direction perpendicular to the transportation direction of the print paper 81, only a notched rough straight line can be drawn, as seen in FIG. 50. It is to be noted that, in FIG. 50, each mark ○ represents a dot, and the numeral in each ○ represents to which numbered dot line the drop belongs.

(iii) The condition and the height of the ink level and the driving waveform of an ultrasonic oscillator when the ultrasonic oscillator is driven to discharge an ink drop are shown in FIGS. 51(*a*), 51(*b*) and 51(*c*), respectively. If the nth driving operation is performed for the ultrasonic oscillator as seen in FIG. 51(*c*), then the ink level is first raised gradually, and then a drop of the ink is separated from the ink and discharged as seen in FIGS. 51(*a*) and 51(*b*). Then, after the ink drop is separated, the ink level drops rapidly, and thereafter, residual oscillations occur for a little while. Therefore, a next n+1th driving operation cannot be performed until the residual oscillations are attenuated to restore a stable ink level. Accordingly, when it is intended to successively discharge ink drops, there is a limitation in reduction of the discharging period, and also there is a limitation in increase in speed of ultrasonic printing.

(iv) In ultrasonic printing, ink to be discharged toward a recording medium is naturally held by a surface tension in a condition wherein the level thereof is exposed to the recording medium (outside). However, depending upon an environmental condition such as a supplying condition of ink or a temperature, the position of the level of the ink may possibly be fluctuated so that the ink level may rise so high that the ink leaks to the outside or the position of the ink level drops and is spaced far away from the recording medium. The converging point of an ultrasonic wave is preferably located in the proximity of the ink level, and unless the ink level is adjusted to its optimum position, stabilized discharging of an ink drop cannot be achieved.

(v) Since the ultrasonic printer shown in FIG. 46 must have a structure wherein the location above the acoustic medium 10 is filled with the ink 16, in order to supply or replace the ink 16 in the ink pool, a separate ink tank is required, and also an ink pump for supplying the ink 16 from the ink tank to the ink pool is required. Meanwhile, the ultrasonic printer shown in FIG. 47 has a different subject to be solved in that, in order to supply ink, a power source for driving the ink transportation belt 26 to move is required and also a mechanism for supplying ink to the ink transportation belt 26 (such as the roller 24 and a driving source to rotate the roller 24) is required, which complicates the structure of the ultrasonic printer.

(vi) An acoustic lens on an acoustic medium is normally formed by etching (refer to, for example, Japanese Patent Laid-Open Application No. Heisei 3-200199). Accordingly, the substrate material which can be used for the acoustic medium is limited to those which allow etching. Further, since the etching depth by one etching operation is uniform, in order to form, for example, such an acoustic Fresnel lens 83 as shown in FIG. 52 on an acoustic medium 84, a plurality of different masks having openings of different sizes must be prepared and, using the masks, a plurality of etching processes must be performed exchanging the used mask to change the size of the opening to form the acoustic Fresnel lens 83 in a staircase-like configuration. To this end, the steps of masking and etching must be repeated a plurality of times. Consequently, the acoustic lens has a subject to be solved in that, due to the repetitions of the masking and etching steps, a high cost is required and the formation processing cannot be automated, and the working efficiency of acoustic lenses is very low.

SUMMARY OF THE INVENTION

It is an object of the present invention to provide an ultrasonic printing method, an ultrasonic printing apparatus and a method of formation of an acoustic lens by which ultrasonic printing can be realized with certainty and high resolution recording can be achieved by ultrasonic printing.

In order to attain the object described above, according to a first aspect of the present invention, there is provided an ultrasonic printing method of a phased array type wherein some or all of a plurality of ultrasonic oscillators for emitting ultrasonic waves to be irradiated as converging ultrasonic waves upon ink to discharge the ink in the proximity of a converging point of the converging ultrasonic waves as an ink drop to stick to a recording medium to form a dot on the recording medium in order to perform recording on the recording medium are selectively driven, in order to discharge the ink, in two or more phases different from each other so that the ultrasonic waves emitted from the selected ultrasonic oscillators are converged to a predetermined point, comprising the step of selectively driving some or all of the ultrasonic oscillators in such phases that a difference in phase at the predetermined point between a reference ultrasonic wave from one of the selected ultrasonic oscillators and another ultrasonic wave from any other one of the selected ultrasonic oscillators is equal to or less than one-fourth a wavelength of the ultrasonic waves in a transmission medium for the ultrasonic waves from the selected ultrasonic oscillators to the predetermined point. Preferably, any one of the selected ultrasonic oscillators is not driven when a difference in phase at the predetermined point between an ultrasonic wave emitted from an end portion of an ultrasonic oscillation face of the ultrasonic oscillator and the reference ultrasonic wave is equal to or greater than one-fourth the wavelength of the ultrasonic waves.

According to a second aspect of the present invention, there is provided an ultrasonic printing apparatus of a phased array type, comprising a plurality of ultrasonic oscillators for emitting ultrasonic waves to be irradiated as converging ultrasonic waves upon ink to discharge the ink in the proximity of a converging point of the converging ultrasonic waves as an ink drop to stick to a recording medium to form a dot on the recording medium in order to perform recording on the recording medium, and a control circuit for controlling the ultrasonic oscillators to be selectively driven, in order to discharge the ink, in two or more different phases so that the ultrasonic waves emitted from the selected ultrasonic oscillators are converged to a predetermined point, the control circuit controlling the ultrasonic oscillators so that some or all of the ultrasonic oscillators are selectively driven in such phases that a difference in phase at the predetermined point between a reference ultrasonic wave from one of the selected ultrasonic oscillators and another ultrasonic wave from any other one of the selected ultrasonic oscillators is equal to or less than one-fourth a wavelength of the ultrasonic waves in a transmission medium for the ultrasonic waves from the selected ultrasonic oscillators to the predetermined point. Preferably, the control circuit controls the ultrasonic oscillators such that any one of the selected ultrasonic oscillators is not driven when a difference in phase at the predetermined point between an ultrasonic wave emitted from an end portion of an ultrasonic oscillation face of the ultrasonic oscillator and the reference ultrasonic wave is equal to or greater than one-fourth the wavelength of the ultrasonic waves.

The ultrasonic printing apparatus may further comprise a storage section for storing in advance information regarding which ones of the ultrasonic oscillators are to be driven at a time so as to converge ultrasonic waves to the predetermined point and information regarding phases of the ultrasonic oscillators to be driven then as a driving pattern, the control circuit being operable, when ink is to be discharged, to read out one of the driving patterns based on a position of a point to which ultrasonic waves are to be converged from the storage section and output the thus read out driving pattern as a serial signal, a shift register for successively shifting the serial signal from the control circuit to store the driving pattern for use to discharge the ink, a latch circuit for receiving and temporarily storing the driving pattern transferred thereto from the shift register, and a driving circuit for selectively outputting signals of predetermined phases to the ultrasonic oscillators to be driven at a time in response to the driving pattern stored in the latch circuit so that the ultrasonic oscillators to be driven at a time are driven with the respective predetermined phases.

With the ultrasonic printing method and the ultrasonic printing apparatus according to the first and second aspects of the present invention, any ultrasonic wave having a phase which does not contribute to discharging of an ink drop, that is, any ultrasonic wave whose phase difference at the converging point from the reference ultrasonic wave is equal to or greater than one-fourth a wavelength of the ultrasonic waves, can be prevented from arriving at the converging point. Consequently, it can be prevented that ultrasonic waves from a plurality of ones of the ultrasonic oscillators cancel each other in phase at the converging point. Consequently, discharging of an ink drop can be performed with certainty without inviting a great drop in energy (electric power) efficiency. Accordingly, an effect obtained by employing ultrasonic printing of the phased array type, that is, the effect that, by means of ultrasonic oscillators arranged at a sufficiently fine pitch, dots of a pitch finer than the pitch of the ultrasonic oscillators can be recorded and consequently ultrasonic printing of a high resolution can be realized, can be achieved.

According to a third aspect of the present invention, there is provided an ultrasonic printing method wherein an ultrasonic wave to be irradiated as a converging ultrasonic wave upon ink is emitted to discharge the ink in the proximity of a converging point of the converging ultrasonic wave as an ink drop to stick to a recording medium to form a dot on the recording medium in order to perform recording on the recording medium, comprising the step of varying a frequency of the converging ultrasonic wave with respect to time within a predetermined frequency range centered at a standard resonance frequency. A time required for variation of the frequency of the converging ultrasonic wave within the predetermined frequency range may be varied.

According to a fourth aspect of the present invention, there is provided an ultrasonic printing apparatus, comprising at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium, and a control circuit for controlling the ultrasonic oscillator so that a frequency of the converging ultrasonic wave to be emitted from the ultrasonic oscillator is varied with respect to time within a predetermined frequency range centered at a standard resonance frequency. The control circuit may be capable of varying a time required for variation of the frequency of the converging ultrasonic wave to be emitted from the ultrasonic oscillator within the predetermined frequency range.

With the ultrasonic printing method and the ultrasonic printing apparatus according to the third and fourth aspects of the present invention, since the frequency of converging ultrasonic waves is varied with respect to time within the predetermined frequency range centered at the standard resonance frequency, even if the condition of the ink varies to vary the optimum resonance frequency with which a maximum energy efficiency is obtained for discharging of an ink drop, ultrasonic waves of the optimum resonance frequency can be discharged with certainty. Consequently, discharging of ink can be performed with certainty without depending upon the condition of the ink, and stabilized ultrasonic printing can be achieved.

According to a fifth aspect of the present invention, there is provided an ultrasonic printing apparatus, comprising means for transporting a recording medium in a transportation direction, and a recording head having a plurality of ultrasonic oscillators arranged in a straight line thereon for emitting ultrasonic waves to be irradiated as converging ultrasonic waves upon ink to discharge the ink in the proximity of a converging point of the converging ultrasonic waves as an ink drop to stick to a recording medium to form a dot on the recording medium in order to perform recording on the recording medium, the recording head being disposed such that a direction in which the ultrasonic oscillators are arranged is inclined by a predetermined angle with respect to a direction of a line of dots to be formed perpendicular to the transportation direction of the recording medium.

The ultrasonic printing apparatus may further comprise a control circuit for controlling the ultrasonic oscillators of the recording head such that some or all of the ultrasonic oscillators are driven at a time to discharge a plurality of ink drops at a time from the recording head to form a plurality of dots, which do not interfere with each other, at a time on the recording medium.

The control circuit may control the ultrasonic oscillators so that ink drops to form dots in a same dot column are successively discharged to the recording medium, which is transported at a fixed speed, at time intervals equal to a value obtained by multiplying a number of dots based on a distance between dots to be formed at a time by a discharging period of ink drops.

With the ultrasonic printing apparatus according to the fifth aspect of the present invention, since the recording head on which the plurality of ultrasonic oscillators are arranged in a straight line is disposed such that it is inclined by the predetermined angle with respect to the direction of a line of dots perpendicular to the transportation direction of the recording medium, when adjacent dots are successively recorded while the recording medium is moved, the adjacent dots can be recorded on the same straight line in the dot line direction on the recording medium. Consequently, a smooth straight line can be drawn in the dot line direction, and a much improved print quality can be obtained.

According to a sixth aspect of the present invention, there is provided an ultrasonic printing method wherein an ultrasonic wave to be irradiated as a converging ultrasonic wave upon ink is emitted to discharge the ink in the proximity of a converging point of the converging ultrasonic wave as an ink drop to stick to a recording medium to form a dot on the recording medium in order to perform recording on the recording medium, comprising the step of emitting, after discharging of each ink drop, at a same ink drop discharging position as that in the last ink drop discharging operation when a position of a level of the ink becomes lower than a position of the ink level in a stable condition of the ink level due to residual oscillations of the ink level, a converging ultrasonic wave having energy insufficient to discharge an ink drop to the ink.

In the ultrasonic printing method according to the sixth aspect of the present invention, when the position of the level of the ink becomes lower than the position of the ink level in the stable condition of the ink level due to residual oscillations of the ink level, an ultrasonic wave having energy insufficient to discharge an ink drop is emitted to the ink. Consequently, the ink level can be stabilized compulsorily.

According to a seventh aspect of the present invention, there is provided an ultrasonic printing method wherein an ultrasonic wave to be irradiated as a converging ultrasonic wave upon ink is emitted to discharge the ink in the proximity of a converging point of the converging ultrasonic wave as an ink drop to stick to a recording medium to form a dot on the recording medium in order to perform recording on the recording medium, comprising the step of emitting, when a next ink drop is to be discharged, immediately after discharging of an ink drop, successively for the same dot, a converging ultrasonic wave having energy based on a position of a level of the ink which is moved by residual oscillations of the ink level to the ink.

In this instance, when the position of the ink level is higher than a position of the ink level in a stable condition of the ink level, a converging ultrasonic wave having energy lower than energy to be applied to the ink level in a stable condition of the ink level may be emitted to the ink, but when the position of the ink level is lower than a position of the ink level in a stable condition of the ink level, a converting ultrasonic wave having energy higher than energy to be applied to the ink level in a stable condition of the ink level may be emitted to the ink. The energy based on the position of the ink level may be controlled by a voltage to be applied to an ultrasonic oscillator from which the ultrasonic wave is to be emitted, or by an emission time of the ultrasonic wave.

With the ultrasonic printing method according to the seventh aspect of the present invention, a converging ultrasonic wave having energy based on the position of the level of the ink which is moved by residual oscillations of the ink level is emitted to the ink to discharge an ink drop. Consequently, a next ink drop can be discharged successively without waiting until the ink level becomes stabilized after discharging of the last ink drop.

According to an eighth aspect of the present invention, there is provided an ultrasonic printing apparatus which realizes the method according to the sixth aspect of the present invention described above, and comprises at least one ultrasonic oscillator for being driven to emit an ultrasonic wave to be irradiated as converging ultrasonic wave upon ink to discharge the ink in the proximity of a converging point of the converging ultrasonic wave as an ink drop to stick to a recording medium to form a dot on the recording medium in order to perform recording on the recording medium, and a control circuit for controlling a driving condition of the ultrasonic oscillator so that the ultrasonic oscillator emits, after discharging of each ink drop, at a same ink drop discharging position as that in the last ink drop discharging operation when a position of a level of the ink becomes lower than a position of the ink level in a stable condition of the ink level due to residual oscillations of the ink level, a converging ultrasonic wave having energy insufficient to discharge an ink drop to the ink.

With the ultrasonic printing apparatus according to the eighth aspect of the present invention, similarly to the method according to the sixth aspect of the present invention, when the position of the level of the ink becomes lower than the position of the ink level in the stable condition of the ink level due to residual oscillations of the ink level, a converging ultrasonic wave having energy insufficient to discharge an ink drop is emitted to the ink. Consequently, the ink level can be stabilized compulsorily.

According to a ninth aspect of the present invention, there is provided an ultrasonic printing apparatus which realizes the method according to the seventh aspect of the present invention described above, and comprises at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium, and a control circuit for controlling a driving condition of the ultrasonic oscillator so that the ultrasonic oscillator emits, when a next ink drop is to be discharged, immediately after discharging of an ink drop, successively for the same dot, a, ultrasonic wave having energy based on a position of a level of the ink which is moved by residual oscillations of the ink level to the ink.

In this instance, the control circuit may control the driving condition of the ultrasonic oscillator so that, when the position of the ink level is higher than a position of the ink level in a stable condition of the ink level, a converging ultrasonic wave having energy lower than energy to be applied to the ink level in a stable condition of the ink level is emitted to the ink, but when the position of the ink level is lower than a position of the ink level in a stable condition of the ink level, a converging ultrasonic wave having energy higher than energy to be applied to the ink level in a stable condition of the ink level is emitted to the ink. Further, the control circuit may control the energy based on the position of the ink level by a voltage to be applied to the ultrasonic oscillator or by an emission time of the ultrasonic wave from the ultrasonic oscillator.

With the ultrasonic printing apparatus according to the ninth aspect of the present invention, similarly to the method according to the seventh aspect of the present invention, a converging ultrasonic wave having energy based on the position of the level of the ink which is moved by residual oscillations of the ink level is emitted to the ink to discharge an ink drop. Consequently, a next ink drop can be discharged successively without waiting until the ink level becomes stabilized after discharging of the last ink drop.

Thus, with the ultrasonic printing methods and apparatus according to the sixth to ninth aspects of the present invention, by compulsorily stabilizing the ink level when the ink level is moved by residual oscillations caused by discharging of an ink drop or by emitting a converging ultrasonic wave having energy based on the position of the ink level during the residual oscillations to the ink to discharge an ink drop, a next ink drop can be discharged successively without waiting until the ink level becomes stabilized. Consequently, the ultrasonic printing methods and apparatus are advantageous in that the discharging period of ink drops can be reduced remarkably to achieve ultrasonic printing of a higher speed and a higher resolution.

According to a tenth aspect of the present invention, there is provided an ultrasonic printing apparatus, comprising at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium, magnetized ink being used as the ink, means defining an opening in which a level of the ink is positioned and from which an ink dot is to be discharged, and a magnetic field generation section for generating a magnetic field in the opening.

The magnetic field generation section may include a pair of permanent magnets disposed with different magnetic poles opposed to each other across the opening. In this instance, the ultrasonic printing apparatus may further comprise an electromagnet provided for the permanent magnets, and a control circuit for controlling an energization condition of the electromagnet so that the electromagnet forms a magnetic field which is capable of cancelling the magnetic field formed by the permanent magnets when an ink drop is to be discharged or upon ink removing operation.

Or, the magnetic field generation section may include a pair of electromagnets disposed in an opposing relationship to each other across the opening, and further comprising a control circuit for controlling energization conditions of the electromagnets. In this instance, the control circuit may control the energization conditions of the electromagnets so that a height of the ink level in the opening is adjusted by an intensity of a magnetic field formed by producing different magnetic poles in the electromagnets. The control circuit may cancel the energization conditions of the electromagnets when an ink drop is to be discharged or upon ink removing operation. Or the control circuit may control the energization conditions of the electromagnets so that, upon ink removing operation, the electromagnets generate magnetic fields which repel each other.

With the ultrasonic printing apparatus according to the tenth aspect of the present invention, by using magnetized ink as the ink and forming a magnetic field in the opening for the ink level by means of the magnetic field generation section, the ink level can be held at a suitable position in the opening based on the magnetic field. Here, where the magnetic field formed by the magnetic field generation section can be cancelled upon discharging of an ink drop or upon an ink removing operation, discharging of an ink or removal of ink can be performed without being influenced by any magnetic field.

According to an eleventh aspect of the present invention, there is provide an ultrasonic printing apparatus, comprising at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium, electro-viscous ink being used as the ink, means defining an opening in which a level of the ink is positioned and from which an ink drop is to be discharged, and an electric field generation section for generating an electric field in the opening.

The ultrasonic printing apparatus may be constructed such that the electric field generation section includes a pair of electrodes disposed in an opposing relationship to each other across the opening, and the printing apparatus further comprises a control circuit for controlling energization conditions of the electromagnets. In this instance, the control circuit may control the energization conditions of the electrodes so that a height of the ink level in the opening is adjusted by a potential difference produced between the electrodes. The control circuit may cancel the energization conditions of the electrodes when an ink drop is to be discharged or upon ink removing operation.

With the ultrasonic printing apparatus according to the eleventh aspect of the present invention, similarly to the ultrasonic printing apparatus according to the tenth aspect of the present invention, by using electro-viscous ink as the ink and forming an electric field in the opening for the ink level by means of the electric field generation section, the ink level can be held at a suitable position in the opening based on the electric field. Here, where the electric field formed by the electric field generation section can be cancelled upon discharging of an ink drop or upon an ink removing operation, discharging of an ink or removal of ink can be performed without being influenced by any electric field.

With the ultrasonic printing apparatus according to the tenth and eleventh aspects of the present invention, by using magnetized ink or electro-viscous ink as the ink, the ink level can be adjusted to and held at a suitable position, that is, in the proximity of the converging point of ultrasonic waves by a magnetic field or an electric field, and consequently, stabilized discharging of an ink drop and hence stabilized ultrasonic printing can be achieved. In this instance, by cancelling the magnetic field or the electric field upon discharging of an ink drop or upon an ink removing operation, discharging of an ink drop or removal of ink can be performed with certainty without being influenced by any magnetic or electric field.

According to a twelfth aspect of the present invention, there is provided an ultrasonic printing apparatus, comprising at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium, an acoustic medium having an acoustic lens formed thereon for converging the ultrasonic wave from the ultrasonic oscillator into a converging ultrasonic wave, and an ink cartridge containing the ink therein and having an opening formed therein in which a level of the ink is formed and from which an ink drop can be discharged to the outside, the ink cartridge being removably mounted on the acoustic medium.

The ultrasonic printing apparatus may be constructed such that the acoustic lens is filled with a filler, and a surface of the acoustic medium adjacent the ink cartridge is formed as a flat face such that the ink cartridge is mounted in a closely contacting condition on the surface in the form of a flat face of the acoustic medium adjacent the ink cartridge. The ink cartridge may be mounted in a closely contacting condition with a surface of the acoustic lens of the acoustic medium.

The ultrasonic printing apparatus may further comprise an intermediate layer interposed between the acoustic medium and the ink cartridge. Preferably, the intermediate layer is a resilient member, or has an intermediate acoustic impedance between an acoustic impedance of the acoustic medium and an acoustic impedance of the ink cartridge, or else has a thickness equal to an odd number of times a quarter wavelength of the ultrasonic wave to be emitted from the acoustic lens. Or, a wall of the ink cartridge adjacent the acoustic medium may have an intermediate acoustic impedance between an acoustic impedance of the acoustic medium and an acoustic impedance of the ink in the ink cartridge.

With the ultrasonic printing apparatus according to the twelfth aspect of the present invention, since the ink cartridge is removably mounted on the acoustic medium on which the acoustic lens is formed, ink can be supplied without provision of a complicated mechanism or structure such as a pump for ink or a power source for such pump. In this instance, where the material, the acoustic impedance or the thickness of the intermediate layer interposed between the acoustic medium and the ink cartridge or the acoustic impedance of the wall itself of the ink cartridge is taken into consideration, an ultrasonic wave from the acoustic medium can be transmitted with certainty to the ink in the ink cartridge.

In this manner, the ultrasonic printing apparatus according to the twelfth aspect of the present invention is advantageous in that, by removably mounting the ink cartridge on the acoustic medium, ink can be supplemented or supplied very readily by replacement of the ink cartridge and the structure of the apparatus can be simplified. In this instance, by suitably setting the acoustic impedance or the thickness between the acoustic medium and the ink cartridge, an ultrasonic wave from the acoustic medium can be transmitted with certainty to the ink in the ink cartridge. Consequently, even where ink is supplied making use of a cartridge, ink can be discharged with certainty.

According to a thirteenth aspect of the present invention, there is provided a method of forming an acoustic lens, which converges an acoustic wave having been transmitted in an acoustic medium to a predetermined converging point, on the acoustic medium, comprising the step of irradiating an excimer laser beam upon the acoustic medium to form the acoustic lens on the acoustic medium.

The method may be constructed such that, when a cylindrical acoustic lens having a cylindrical concave face is to be formed as the acoustic lens on the acoustic medium, a mask having an opening of a profile having a size equal to a multiple of a size of a cross section of the cylindrical acoustic lens to be formed by a fixed value with regard to a depthwise direction of the acoustic lens is prepared in advance, and the excimer laser beam is irradiated upon the acoustic medium through the opening of the mask while at the same time the acoustic medium is moved at a fixed speed in a predetermined direction relative to the mask.

Or, the method may be constructed such that, when a spherical acoustic lens having a spherical concave face is to be formed as the acoustic lens on the acoustic medium, at least one mask having a plurality of circular openings having different diameters from each other based on a diameter and a depth of the spherical acoustic lens to be formed is prepared in advance, and the excimer laser beam is successively irradiated upon the acoustic medium through each of the openings of the mask. In this instance, the method may be constructed such that the plurality of openings are formed in a successive arrangement in the mask in advance, and the excimer laser beam is successively irradiated upon the acoustic medium through each of the openings of the mask while the mask is successively moved in a direction of the arrangement of the openings.

Or else, the method may be constructed such that, when an acoustic Fresnel lens having an equivalent function to that of a spherical acoustic lens having a spherical concave face is to be formed as the acoustic lens on the acoustic medium, at least one mask having a plurality of concentrical slits having different diameters from each other based on an outer diameter of the acoustic Fresnel lens to be formed is prepared in advance, and the excimer laser beam is successively irradiated upon the acoustic medium through each of the slits of the mask. In this instance, each of the slits may be formed as a pair of openings for different half circles in the mask. Or, the slits may be formed by covering a light passing member, which passes light of a wavelength of the excimer laser beam, at any location other than portions to form the slits with a mask member.

With the method of forming an acoustic lens according to the thirteenth aspect of the present invention, since an excimer laser beam is employed, an acoustic lens can be formed readily comparing with an ordinary method wherein an acoustic lens is formed by etching, and formation processing of an acoustic lens can be automated. In this instance, by irradiating the excimer laser beam using a mask having an opening of a suitable profile, various acoustic lenses such as a cylindrical acoustic lens, a spherical acoustic lens or an acoustic Fresnel lens can be formed on an acoustic medium.

In this manner, with the acoustic lens formation method according to the thirteenth aspect of the present invention, since an acoustic lens can be formed very readily and formation processing of an acoustic lens can be automated by using an excimer laser beam, the production cost of an acoustic lens can be reduced and the working efficiency of an acoustic lens can be improved remarkably.

In this manner, according to the present invention, various problems which are encountered in realization of ultrasonic printing are solved and ultrasonic printing can be realized with certainty. Further, recording of a high resolution can be achieved by ultrasonic printing.

Further objects, features and advantages of the present invention will become apparent from the following detailed description when read in conjunction with the accompanying drawings in which like parts or elements are denoted by like reference characters.

DESCRIPTION OF THE PREFERRED EMBODIMENTS

Figure 2:
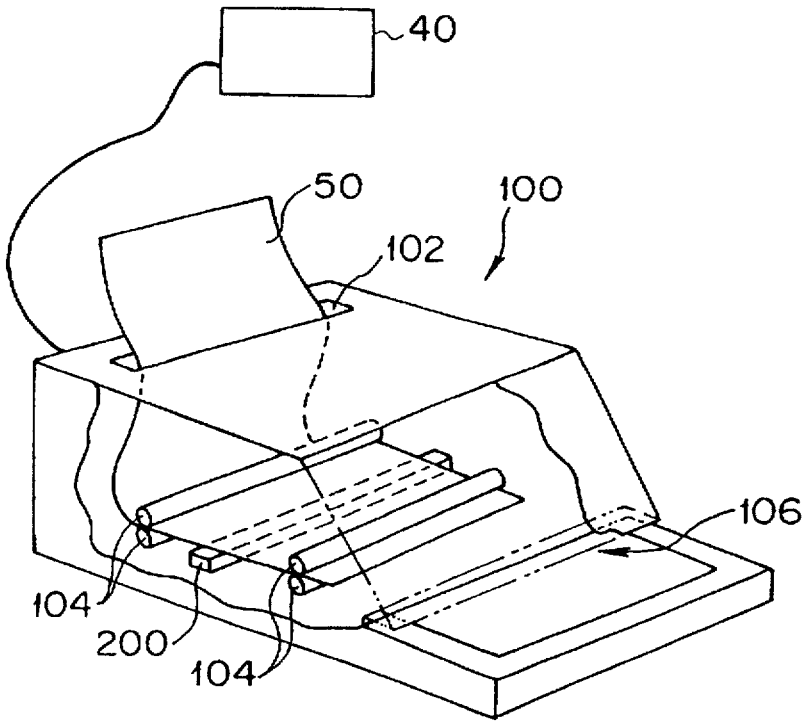
FIG. 2 is a schematic perspective view showing, partly broken, a structure of an ultrasonic printer or printing apparatus to which the present invention is applied.

Referring first to FIG. 2, there is shown in perspective view partly broken a structure of an ultrasonic printer or printing apparatus to which the present invention is applied. The ultrasonic printer is generally denoted at 100 and is connected, for example, to a personal computer 40 serving as a host computer or unit so that it receives information of characters and/or a graphic pattern to be recorded (such information is hereinafter referred to as recording information) and prints the recording information.

The ultrasonic printer 100 has a paper inlet hole 102 formed at a rear portion of an upper wall thereof so that a recording paper (recording medium) 50 is inserted into the ultrasonic printer 100 through the paper inlet hole 102. The recording paper 50 inserted in the ultrasonic printer 100 is held between and successively transported by pairs of rollers 104, which are driven to rotate by a motor (not shown) in a forward direction, that is, in a rightward direction in FIG. 2. While the recording paper 50 is transported, it passes a location above a recording head (print head) 200.

When the recording paper 50 passes the location above or the top of the recording head 200, recording is performed by the recording head 200 on the recording paper 50 in accordance with recording information sent thereto from the personal computer 40. Thereafter, the recording paper 50 is discharged through a paper outlet hole 106 formed in a front fall (right wall in FIG. 2) of the ultrasonic printer 100.

It is to be noted that, in FIG. 2, recording on the recording paper 50 inserted in through the paper inlet hole 102 is performed while the recording paper 50 is moving with respect to the recording head 200. However, it is only required that the recording paper 50 and the recording head 200 move relative to each other. Accordingly, the ultrasonic printer 100 may be constructed otherwise such that the recording head 200 moves with respect to the recording paper 50. Further, the recording paper 50 may be automatically supplied from a tray or a like structure not shown.

Figure 3:
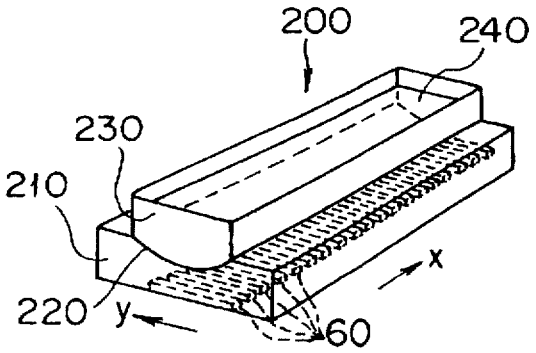
FIG. 3 is an enlarged schematic perspective view showing a recording or print head of the ultrasonic printer shown in FIG. 2.

FIG. 3 shows in perspective view the recording head (print head) 200 of the ultrasonic printer 100 shown in FIG. 2. Referring to FIG. 3, a large number of ultrasonic oscillators 60 having an elongated rectangular profile are arranged and fixedly mounted in a predetermined spaced relationship (at a fixed arrangement pitch) from each other in a predetermined arrangement direction (x direction in FIG. 3) thereof on a lower face of an acoustic medium (substrate) 210.

Meanwhile, an acoustic cylindrical lens 220 serving as an acoustic lens is formed on the top face of the acoustic medium 210 from a semi-cylindrical recess having a curvature and extending in a y direction perpendicular to the predetermined arrangement direction (x direction).

The acoustic medium 210 is formed from a material in which an ultrasonic wave is transmitted at a velocity higher than the velocity at which the ultrasonic wave is transmitted in the inside of ink. Consequently, the acoustic cylindrical lens 220 exhibits an action to converge an ultrasonic wave, which has been transmitted in the acoustic medium 210, with regard to the y direction.

Meanwhile, in the arrangement shown in FIG. 3, an ink reservoir 230 is fixed at the top of the acoustic cylindrical lens 220, and ink 240 is filled in the ink reservoir 230. The recording paper 50 (refer to FIG. 2) which is an object of recording passes the location just above the ink reservoir 230.

Here, as an example, it is presumed that high resolution recording with the dot size of 0.06 mm and at the dot pitch of 0.06 mm is performed on the recording paper 50, and a center frequency of ultrasonic waves emitted from the ultrasonic oscillators 60 is set to 50 MHz and the arrangement pitch of the ultrasonic oscillators 60 is set to 0.06 mm.

Further, if it is assumed that the recording width is 200 mm and the recording head 200 is stationary, then the length of the recording head 200 in the x direction is 200 mm and the number of ultrasonic oscillators 60 thus arranged is 3,200.

Further, the number of those ultrasonic oscillators 60 to be driven to form one dot is 16, that is, the driving aperture is 1.0 mm.

It is to be noted that, while the apparatus of FIG. 2 includes the recording head 200 of the stationary type, where it otherwise includes a moving mechanism for moving the recording head 200 in the leftward and rightward directions (x direction), it is possible to record for the predetermined recording width using a recording head shorter than the predetermined recording width, and in this instance, the required number of ultrasonic oscillators 60 of the recording head can be reduced.

By the way, where such dimensions as mentioned above are employed, based on a principle (of ultrasonic printing of the phased array type) which will be hereinafter described, ultrasonic waves emitted from the 16 ultrasonic oscillators 60 are converged with the beam width of 0.03 mm in the proximity of the free surface of the ink 240, and an ink drop of the diameter of 0.03 mm is discharged from the location. As the ink drop of the diameter of 0.03 mm sticks to the recording paper 50, a dot of the dot size of 0.06 mm is recorded on the recording paper 50. It is to be noted here that, since a model of ultrasonic waves emitted from such 16 ultrasonic oscillators 60 is cumbersome to draw, the description below is sometimes based on the assumption that, in order to discharge an ink drop to form one dot, ultrasonic waves are emitted from a smaller number of, for example, 6, ultrasonic oscillators 60 for convenience of illustration and description.

Figure 4:
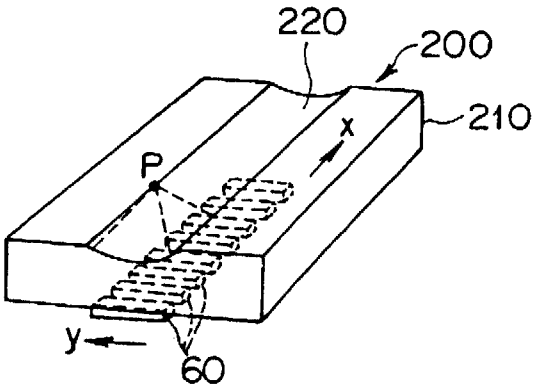
FIG. 4 is a schematic perspective view showing an acoustic medium of the recording head shown in FIG. 3 with an ink reservoir removed.
Figure 5A:
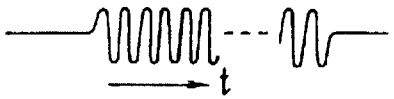
FIGS. 5(*a*) to 5(*f*) are waveform diagrams illustrating a fundamental principle in which ultrasonic waves are converged in an ultrasonic printing system of the phased array type.
Figure 5B:
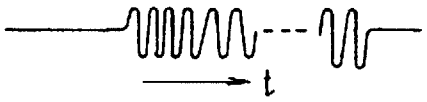
Figure 5C:
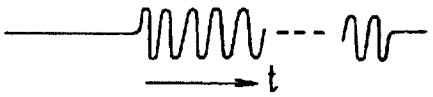
Figure 5D:
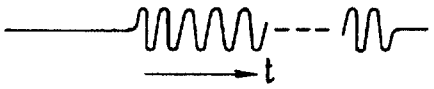
Figure 5E:
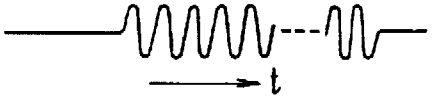
Figure 5F:
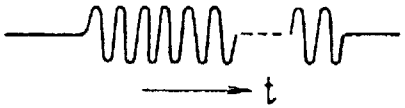

FIG. 4 shows in perspective view the recording head 200 (acoustic medium 210) from which the ink reservoir 230 is removed. Referring to FIG. 4, in order to discharge an ink drop to form one dot, for example, six ones of the large number of ultrasonic oscillators 60 shown are driven so that ultrasonic waves are emitted individually from the six ultrasonic oscillators 60. An ultrasonic wave emitted from each of such ultrasonic oscillators 60 is converged into a small spot of, for example, 0.03 mm in diameter at a position (predetermined point, converging point) P corresponding to the free surface (ink level) of the ink 240 by the acoustic cylindrical lens 220 with regard to the y direction and based on a principle, which will be hereinafter described, with regard to the x direction. When the ultrasonic waves are converged at the position P, an ink drop of 0.03 mm in diameter corresponding to the small spot of the ultrasonic waves is discharged from the free surface of the ink 240.

FIGS. 5(*a*) to 5(*f*) are waveform diagrams illustrating a fundamental principle based on which ultrasonic waves are converged with regard to the x direction, and shows driving waveforms for driving six ultrasonic oscillators 60, that is, waveforms of ultrasonic waves emitted from the six ultrasonic oscillators 60.

Referring to FIGS. 5(*a*) to 5(*f*), the axis of abscissa indicates the time axis t. As seen from FIGS. 5(*a*) to 5(*f*), a pair of ones of the six ultrasonic oscillators 60 at the opposite ends of the arrangement are driven first (refer to FIGS. 5(*a*) and 5(*f*)), and then successive inner side ones of the ultrasonic oscillators 60 are successively driven (refer to FIGS. 5(*b*) to 5(*e*)). Ultrasonic waves emitted from the ultrasonic oscillators 60 driven in this manner are equivalent to an ultrasonic spherical wave formed from an ultrasonic plane wave passing an acoustic lens. The ultrasonic waves emitted from the ultrasonic oscillators 60 are converged at a predetermined point P (refer to FIG. 4). This is the fundamental principle of ultrasonic printing of the phased array type wherein phase-controlled ultrasonic waves are emitted from a plurality of ultrasonic oscillators to discharge one ink drop.

The pattern of driving of ultrasonic oscillators in successively displaced phases in such a manner as seen in FIGS. 5(*a*) to 5(*f*) is referred to as phase pattern. By varying the phase pattern, ultrasonic waves emitted from the six ultrasonic oscillators 60 can be converged not only to a point on a normal line passing the center of the six ultrasonic oscillators 60 to be driven but also to another position displaced in the x direction from the normal line.

Figure 6:
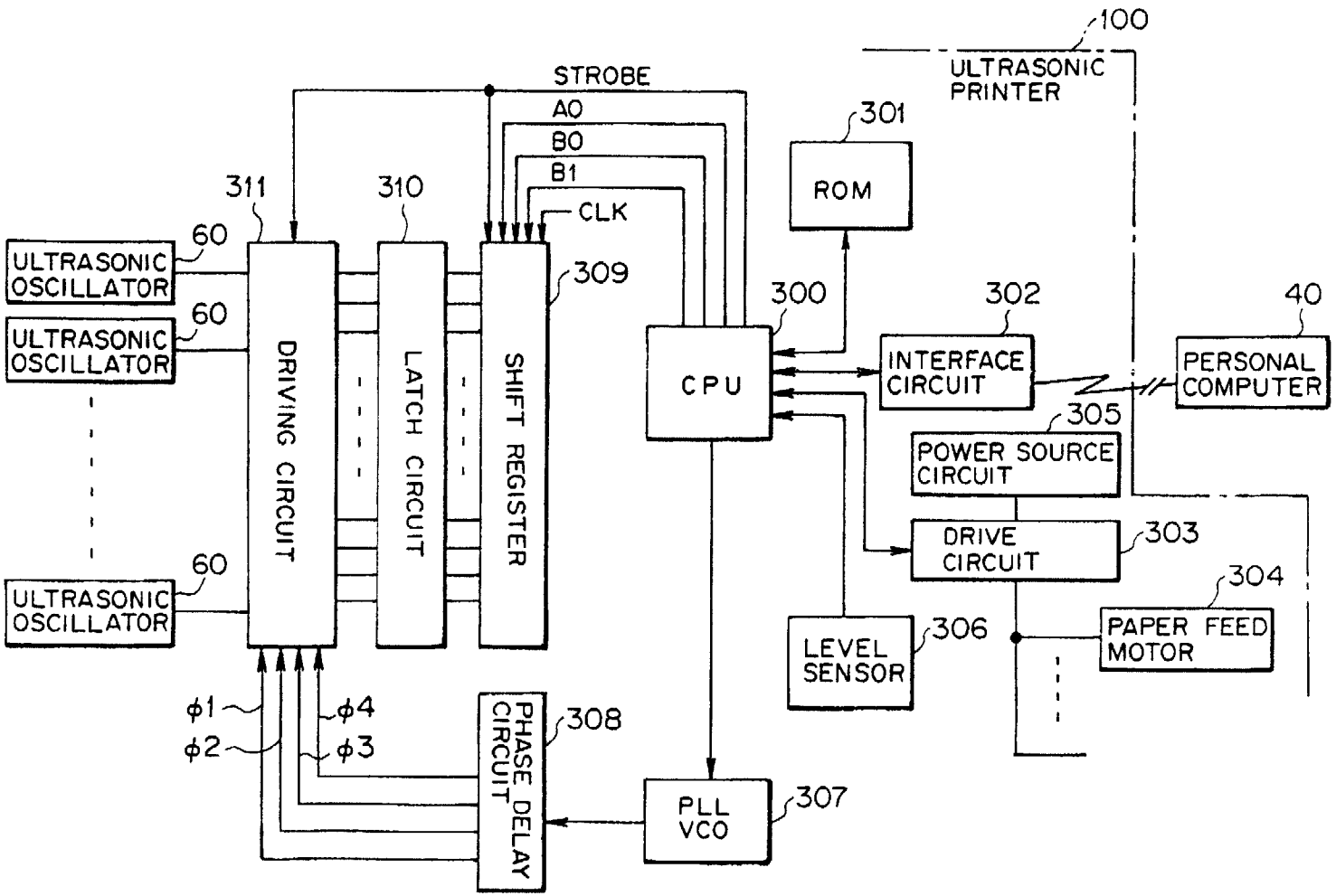
FIG. 6 is a block diagram showing a construction of a control system of the ultrasonic printer shown in FIG. 3.

Referring now to FIG. 6, a construction of a control system for the ultrasonic printer 100 described above is shown. The ultrasonic printer 100 includes, in addition to the ultrasonic oscillators 60 described above, a CPU (central processing unit) 300, a ROM (read only memory) 301, an interface circuit 302, a drive circuit 303, a paper feed motor 304, a power source circuit 305, a level sensor 306, a phase locked loop voltage controlled oscillator (PLL-VCO) 307, a phase delay circuit 308, a shift register 309, a latch circuit 310 and a driving circuit 311 which function as a control system and/or a drive system.

The CPU 300 controls overall operation of the ultrasonic printer 100 and performs its controlling operation in accordance with a program or programs and various data stored in advance in the ROM 301. Particularly, the CPU 300 has a function as a control circuit for controlling, upon discharging of ink, the phases of ultrasonic waves to be emitted from the ultrasonic oscillators 60. Details of the function will be hereinafter described.

The ROM 301 serving as a storage section stores a program or programs and various data as described above. The ROM 301 also stores in advance driving pattern information which designates which ones of the ultrasonic oscillators 60 should be driven for the position of each dot to be recorded, that is, for the position of a point to which ultrasonic waves should be converged, and in what phases ultrasonic waves should be emitted from the ultrasonic oscillators 60 then, or in other words, in the present embodiment, in which ones of four different phases, which will be hereinafter described, the ultrasonic oscillators 60 should be driven.

The interface circuit 302 is connected to the external personal computer (host computer or unit) 40 so that it receives a recording instruction or recording information (information of characters and/or a graphic pattern to be recorded) from the personal computer 40 and transmits it to the CPU 300. The CPU 300 receiving such instruction or information from the interface circuit 302 controls operation of the ultrasonic oscillators 60 and other necessary elements so as to perform predetermined recording on the recording paper 50 (refer to FIG. 2) as hereinafter described.

The ultrasonic printer 100 includes various power systems and operation systems such as the paper feed motor 304 for transporting the recording paper 50, and also those systems are controlled by the CPU 300 by way of the drive circuit 303. The drive circuit 303 supplies, upon reception of an instruction from the CPU 300, power from the power source circuit 305 to those systems (paper feed motor 304 and so forth) to drive them.

The level sensor 306 detects the position of the level of the ink 240 in the inside of the ink reservoir 230 (refer to FIG. 3). A result of the detection by the level sensor 306 is monitored by the CPU 300 and fed back for driving control of the ultrasonic oscillators 60 in response to the position of the ink level. The driving control of the ultrasonic oscillators 60 will be hereinafter described with reference to FIGS. 15(*a*) to 18.

The PLL-VCO 307 receives a voltage signal from the CPU 300 and oscillates a signal of a constant frequency (for example, 50 MHz) corresponding to the voltage signal. The frequency of the signal oscillated from the PLL-VCO 307 varies in accordance with the voltage signal from the CPU 300.

Figure 7:
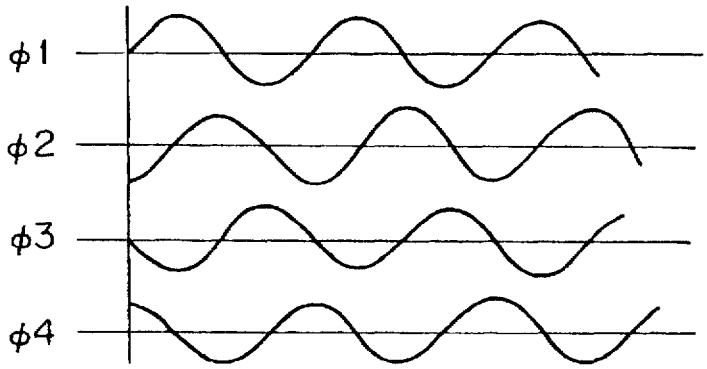
FIG. 7 is a waveform diagram showing four signals having different phases from each other in the ultrasonic printer shown in FIG. 3.

The phase delay circuit 308 successively delays a signal from the PLL-VCO 307 in phase to convert it into a plurality of signals (driving signal) having different phases from each other and outputs the signals. In particular, in the present embodiment, the phase delay circuit 308 outputs, for example, as seen in FIG. 7, four signals $\phi 1$ (0°), $\phi 2$ (90°), $\phi 3$ (180°) and $\phi 4$ (270°) having phases different by 90° (a quarter wavelength) from each other. Here, if any one of the ultrasonic oscillators 60 is driven by one of the signals $\phi 1$ to $\phi 4$, then the ultrasonic oscillator 60 emits an ultrasonic wave having the same phase as the driving signal toward the ink 240 by way of the acoustic medium 210 (acoustic cylindrical lens 220).

The shift register 309 receives a plurality of pieces of information (an image signal A0 and phase difference signals B0 and B1 which will be hereinafter described) regarding a driving pattern each as a serial signal from the CPU 300 and shifts the serial signals in synchronism with a clock signal CLK to store the driving pattern information of all of the ultrasonic oscillators 60 for performing one ink discharging operation.

The driving pattern information stored in this manner in the shift register 309 is transferred to the latch circuit 310 when the shift register 309 receives a strobe signal STROBE from the CPU 300. Meanwhile, the image signal A0 designates those of the ultrasonic oscillators 60 to be driven in a one ink discharging period and provides, for each of the ultrasonic oscillators 60, one bit data representing whether or not the ultrasonic oscillator 60 should be driven. The phase difference signals B0 and B1 are each in the form of one bit data and designate, for each of the ultrasonic oscillators 60, which one of the four signals $\phi 1$ to $\phi 4$ mentioned above should be used to drive it.

The latch circuit 310 receives and temporarily stores driving pattern information transferred thereto from the shift register 309.

The driving circuit 311 selects, upon reception of a strobe signal STROBE from the CPU 300, signals of predetermined phases from among the signals $\phi 1$ to $\phi 4$ from the phase delay circuit 308 in accordance with the driving pattern information (A0, B0, B1) stored in the latch circuit 310 and outputs the selected signals to those of the ultrasonic oscillators 60 which are to be driven at a time. Consequently, those ultrasonic oscillators 60 are driven at a time in the respective predetermined phases. It is to be noted that the driving circuit 311 includes a matrix switch (not shown) which allows one of the four signals $\phi 1$ to $\phi 4$ to be outputted to each of the ultrasonic oscillators 60.

The CPU 300 in the present embodiment thus controls, for discharging of ink drops to form one dot, so that a plurality of (16 per one dot in the present embodiment) ones of the ultrasonic oscillators 60 may individually be driven in such phases that the phase difference at the converging point (refer to the position P in FIG. 4 or the position 0 in FIG. 48) between a reference ultrasonic wave (usually an ultrasonic wave from one of those ultrasonic oscillators 60 positioned at the center among them) and another ultrasonic wave from each of the other ones of those ultrasonic oscillators 60 may be equal to or smaller than one fourth (or be smaller than one fourth) the wavelength $\lambda$ of the ultrasonic waves in the transmission medium for the ultrasonic waves (ink 240).

Further, the CPU 300 in the present embodiment has another function of controlling so that, when an ultrasonic wave emitted from a portion (end portion) in a widthwise direction of any one of the ultrasonic oscillators 60 is displaced in phase by an amount greater than (or by an amount equal to or greater than) one fourth the wavelength $\lambda$ of the ultrasonic wave at the converging point (ink discharging point) from the reference ultrasonic wave, the ultrasonic oscillator 60 (in the example shown in FIG. 48, the 50th ultrasonic oscillator 60A) is prevented from being driven.

More particularly, in the present embodiment, the CPU 300 selects, from among the signals $\phi 4$ to $\phi 4$ having four different phases from each other as seen in FIG. 7, signals which satisfy the requirement described above, and serially outputs designation information (driving pattern information) of those of the ultrasonic oscillators 60 to be driven to form a dot to be recorded in the present printing cycle and signal information (driving pattern information) for driving each of those ultrasonic oscillators 60 as an image signal A0 and phase difference signals B0 and B1 to the shift register 309 so that those ultrasonic oscillators 60 may individually driven by the signals.

It is to be noted that, while the driving pattern information may be calculated, each time an ink drop is to be discharged, for the ink drop discharging point then by the CPU 300, it is rather practical to calculate in advance which ones of the large number of ultrasonic oscillators 60 arranged in the apparatus should be selected and by which phase signals they should be driven based on the height of the ink level 240A (refer to FIG. 48), the arrangement pitch and the width of the ultrasonic oscillators 60 and other necessary factors, store results of the calculation (A0, B0, B1) as driving pattern information in the ROM 301 and, upon discharging of ink, read out a driving pattern in accordance with the ink drop discharging position then from the ROM 301 by means of the CPU 300.

Subsequently, a driving control procedure (ultrasonic wave phase control procedure) of the ultrasonic oscillators 60 upon discharging of an ink drop by the CPU 300 will be described with reference to the flow chart (steps S1 to S13) shown in FIG. 1.

Figure 1:
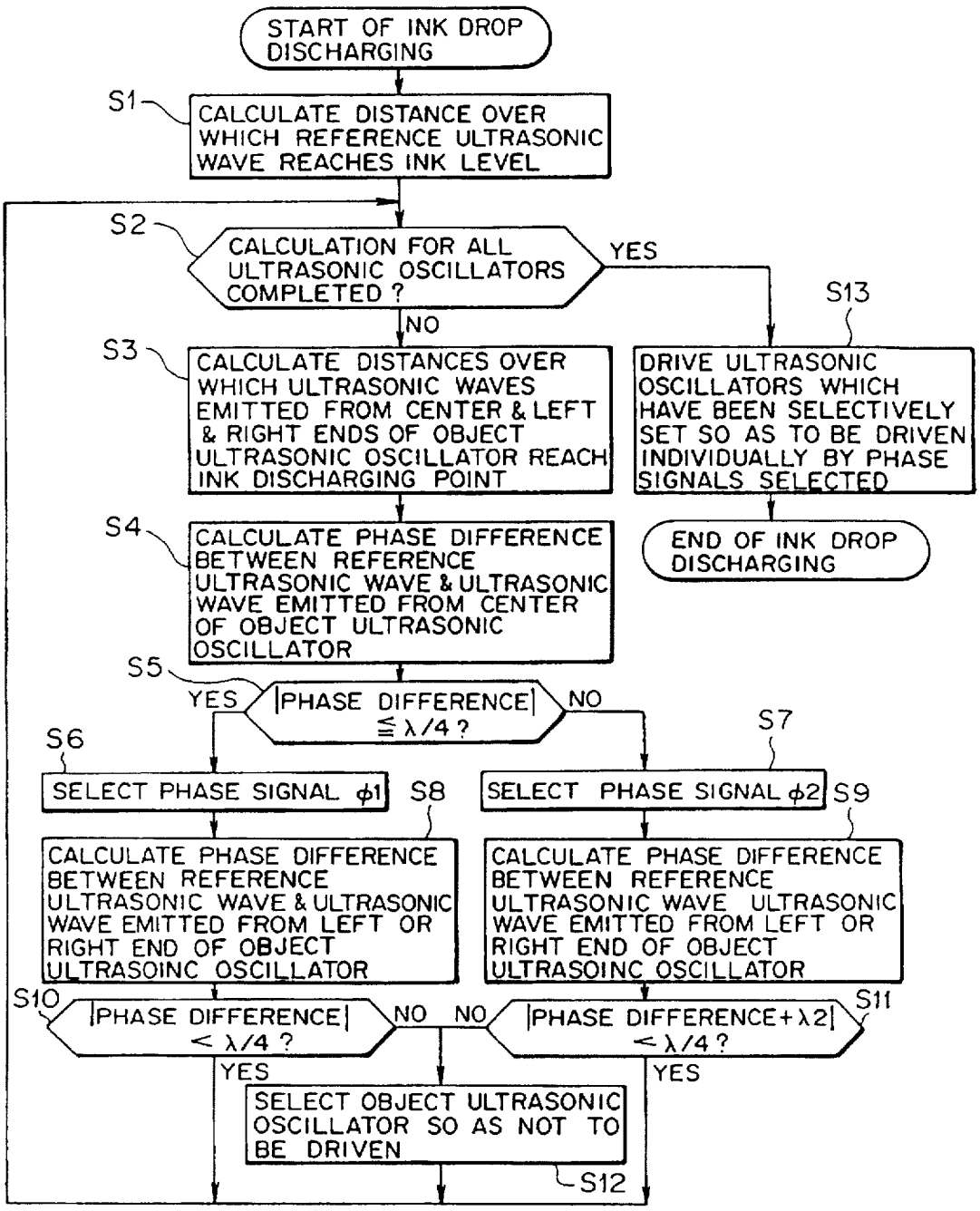
FIG. 1 is a flow chart illustrating an ultrasonic printing method to which the present invention is applied.

It is to be noted that the following description given with reference to FIG. 1 proceeds under the assumption that, for simplified description, the phase delay circuit 308 produces only two different driving signals $\phi 1$ (0°) and $\phi 2$ (180°) having phases different by 180° (half wavelength) from each other. Further, while driving pattern information is calculated, in the procedure illustrated in FIG. 1, in accordance with an ink drop discharging position each time an ink drop is to be discharged, actually the driving control procedure is constructed so that a required driving pattern stored in advance in the ROM 301 is read out as described above.

Referring to FIG. 1, upon starting of discharging of ink, a distance over which a reference ultrasonic wave (reference phase signal) reaches the ink level is calculated first (step S1). This distance corresponds, in the example described hereinabove with reference to FIG. 48, to the distance from the position of the center in a widthwise direction of the 0th ultrasonic oscillator 60 to the the position 0 of the ink level 240A just above the position of the center, that is the height of the ink level 240A.

Then, it is discriminated whether or not such calculation has been completed for all of the ultrasonic oscillators 60 (step S2). At an initial stage of the processing, naturally the calculation for all of the ultrasonic oscillators 60 is not completed, and consequently, the discrimination at step S2 is NO.

When it is discriminated at step S2 that the calculation has not been completed for all of the ultrasonic oscillators 60 (when the discrimination is NO), the CPU 300 calculates distances over which ultrasonic waves emitted from a central position, a left end position and a right end position (points c, a and b in FIG. 48, respectively) in a widthwise direction of a next one of the ultrasonic oscillators 60 reach the ink discharging point (converging point: which corresponds to the position 0) (step S3). Then, the CPU 300 calculates a phase difference at the ink discharging point between the reference ultrasonic wave (reference phase signal) and the ultrasonic wave emitted from the central position in the widthwise direction of the ultrasonic oscillator 60 (step S4).

Thereafter, it is discriminated whether or not an absolute value of the phase difference calculated at step S4 is equal to or smaller than one fourth the wavelength $\lambda$ of the ultrasonic waves (step S5). When it is discriminated that the absolute value is equal to or smaller than $\lambda/4$ (when the discrimination is YES), the signal $\phi 1$ having the same phase as that of the reference signal is selected as the signal (phase signal) for driving the ultrasonic oscillator 60 which is the object of the present calculation processing (step S6). On the contrary when the absolute value is discriminated to be greater than $\lambda/4$ (when the discrimination is NO), the signal $\phi 2$ having a phase different by 180° from that of the reference signal is selected as a signal (phase signal) for driving the ultrasonic oscillator 60 which is the object of the present calculation processing (step S7).

After the processing at step S6 or S7 is performed, the CPU 300 calculates a phase difference at the ink discharging point (converging point) between the reference ultrasonic wave (reference phase signal) and the ultrasonic wave emitted from the left or right end of the ultrasonic oscillator 60 which is the object of the present calculation processing (step S8 or S9). Then, at step S10 next to step S8, it is discriminated whether or not an absolute value of the phase difference calculated at step S8 is smaller then $\lambda/4$, but at step S11 next to step S9, it is discriminated whether or not an absolute value obtained by a value obtained by addition of $\lambda/2$ to the phase difference calculated at step S9 is smaller than $\lambda/4$.

When it is discriminated at step S10 or S11 that the absolute value is smaller than $\lambda/4$ (when the determination is YES), the control sequence returns to step S2. On the contrary when it is discriminated at step S10 or S11 that the absolute value is equal to or greater than $\lambda/4$ (when the discrimination is NO), the CPU 300 selectively sets the ultrasonic oscillator 60 which is the object of the present calculation processing so that it may not be driven (step S12), whereafter the control sequence returns to step S2.

The processes at steps S3 to S12 described above are repeated until it is discriminated at step S2 that the calculation for all of the ultrasonic oscillators 60 has been completed. If the calculation for all of the ultrasonic oscillators 60 has been completed (if the determination at step S2 is YES), then those ultrasonic oscillators 60 which have been selectively set so as to be driven are driven individually by the phase signals selected at steps S5 to S12 (step S13).

Consequently, an ink drop is discharged in the one ink discharging period to form a dot. It is to be noted that it is also possible to discharge a plurality of ink drops at a time in one ink discharging period to record a plurality of dots at a time on the recording paper 50 so that they do not interfere with each other. In this instance, for each position from which an ink drop is to be discharged to form a dot, such calculation as described above is performed to select phase signals.

By selecting phase signals (step S6 or S7) and preventing driving of some ultrasonic oscillators 60 when required (step S12) as described above, any ultrasonic wave which has a phase which does not contribute to discharging of an ink drop, that is, any ultrasonic wave which has a phase different by an amount equal to or greater than $\lambda/4$ at the converging point from the reference ultrasonic wave can be prevented from arriving at the converging point.

Figure 8:
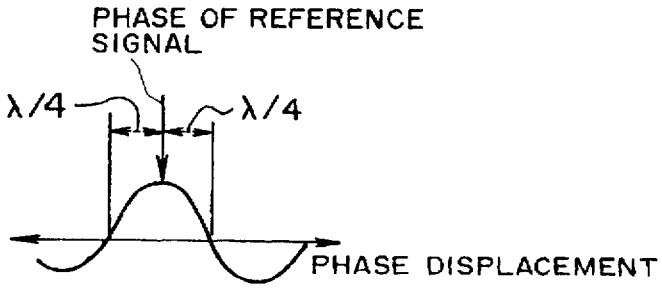
FIG. 8 is a waveform diagram showing a phase of a signal which may cancel a reference signal at a converging point.
Figure 48:
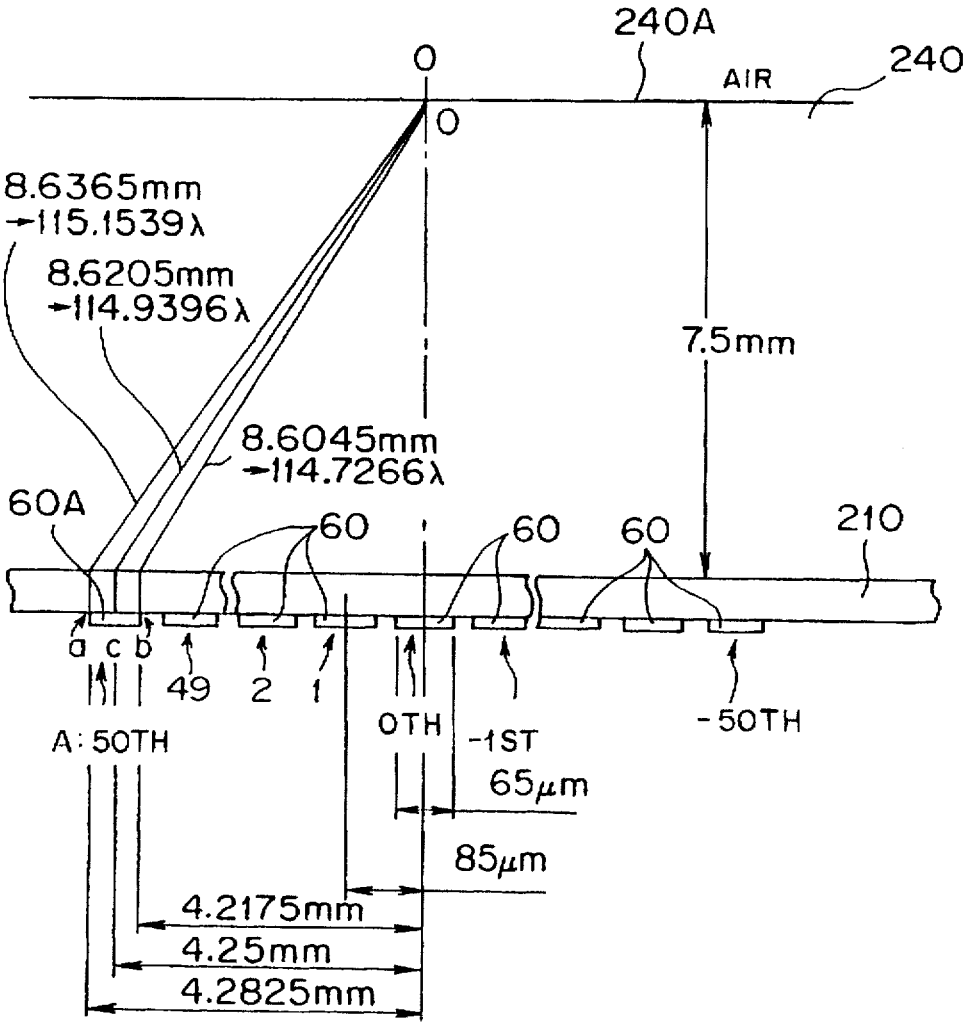
FIG. 48 PRIOR ART
FIG. 48 is a diagrammatic view illustrating interference of signals when ultrasonic printing is performed by an ultrasonic printing system of the phased array type.
Figure 49:
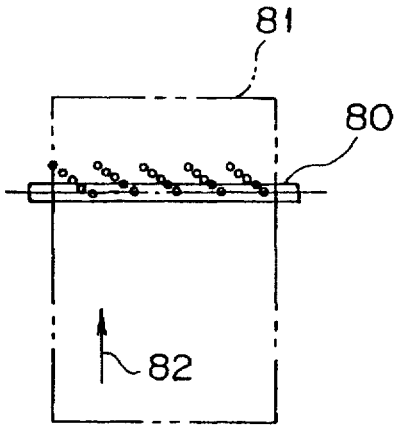
FIG. 49 PRIOR ART
FIG. 49 is a plan view showing an arrangement of a recording or print head in an ordinary ultrasonic printer.
Figure 50:
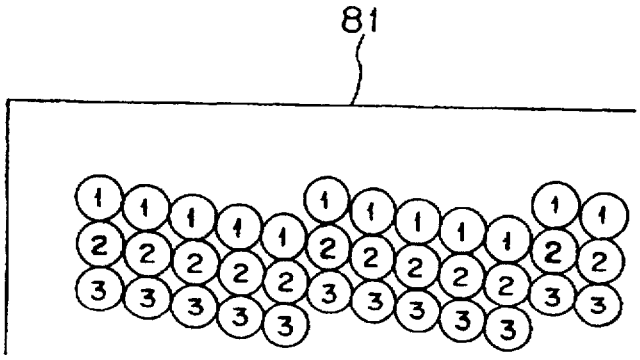
FIG. 50 PRIOR ART
FIG. 50 is a diagrammatic view showing an example of recorded dots obtained by the recording head arranged as shown in FIG. 49.

As described hereinabove also with reference to FIG. 48 and as seen in FIG. 8, if an ultrasonic wave having a phase difference greater by more than λ/4 than the reference ultrasonic wave at the converging point of ultrasonic waves (at the ink discharging point) arrives at the converging point, then the ultrasonic wave partially cancels the other ultrasonic waves. However, in the present embodiment, such a situation as just described is eliminated with certainty.

Further, when the ultrasonic oscillators 60 are driven by a pattern of a comparatively small number of phase signals to discharge an ink drop by ultrasonic printing of the phased array type, since any of the ultrasonic oscillators 60 which does not contribute to discharging of an ink drop is not driven, useless energy dissipation can be eliminated, and an ink drop can be discharged with certainty without inviting a significant drop in energy efficiency.

Consequently, an effect by ultrasonic printing of the phased array type that dots smaller than the pitch of the ultrasonic oscillators 60 by the ultrasonic oscillators 60 which are arranged in a sufficiently small pitch can be printed and ultrasonic printing of a high resolution can be realized can be achieved with certainty.

It is to be noted that, while, in the embodiment described above, the number of different driving signals to be selected described above is two or four, according to the present invention, the number of driving signals is not limited to such specific numbers. Further, also the number of those ultrasonic oscillators 60 which are to be driven to form one dot is not limited to 6 or 16.

Meanwhile, the CPU 300 of the ultrasonic printer 100 of the present embodiment (refer to FIG. 6) has a function as a control circuit which controls (sweep controls) so that the frequency of converging ultrasonic waves to be emitted from the individual ultrasonic oscillators 60 upon discharging of an ink drop may be varied with respect to time within a predetermined frequency range (for example, from $f_L$ to $f_H$ shown in FIGS. 9 to 11) centered at a standard resonance frequency (nominal resonance frequency).

Figure 11:
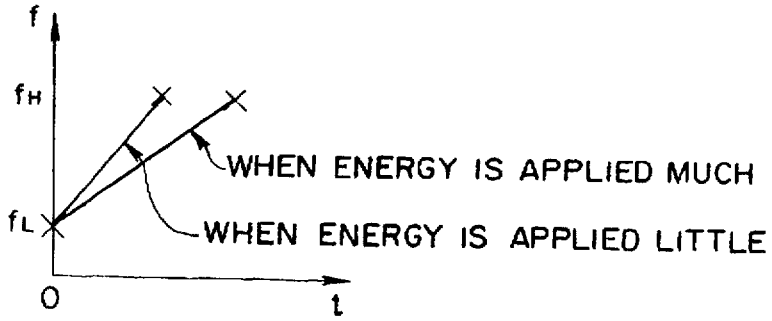
FIG. 11 is a graph illustrating an example of sweep control of a frequency of an ultrasonic wave in the ultrasonic printer shown in FIG. 3.

Further, in this instance, the time required for a variation of the frequency of convergent ultrasonic waves emitted from the ultrasonic oscillators 60 within the predetermined frequency range, that is, the variation rate in frequency or sweep rate, can be varied by the CPU 300 as seen, for example, in FIG. 11 in accordance with the necessity.

Such sweep control of the frequency as described above is performed by varying a voltage to be applied to the PLL-VCO 307 by means of the CPU 300.

The frequency of ultrasonic waves for discharging an ink drop is normally set to a standard resonance frequency (for example, the frequency $f_0$ in FIG. 9) in accordance with a condition of ink. Where the resonance frequency is used, an ink drop can be discharged with a high energy efficiency. However, if the condition of the ink such as an ink temperature varies, then also the resonance frequency varies.

Figure 9:
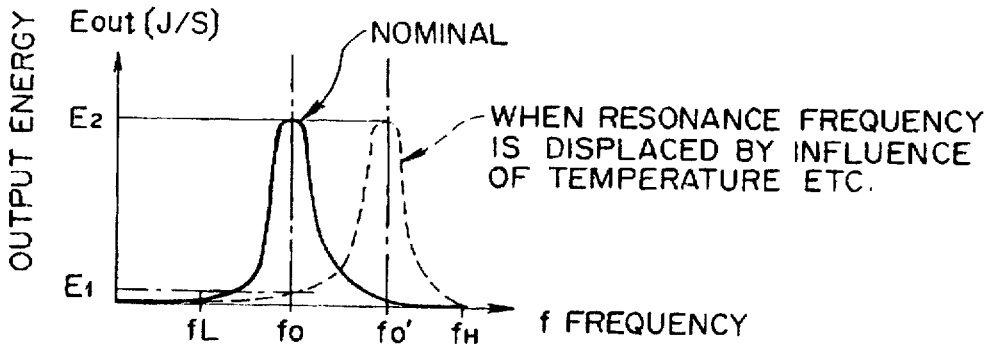
FIG. 9 is a graph illustrating a relationship between a frequency of an ultrasonic wave and output energy.

For example, if the resonance frequency is displaced from $f_0$ to $f_0'$ ($>f_0$) as seen in FIG. 9 by an influence of the temperature, then even if an ultrasonic oscillator 60 is driven by the resonance frequency $f_0$, the output energy Eout which can be extracted as dynamic energy decreases very much from $E_2$ to $E_1$ ($<E_2$) until it may become impossible to discharge an ink drop.

Figure 10:
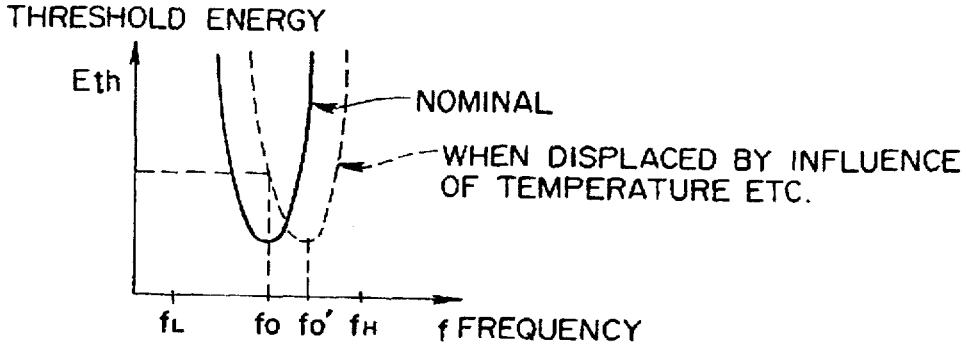
FIG. 10 is a graph illustrating a relationship between a frequency of an ultrasonic wave and threshold energy.

Similarly, if the resonance frequency is displaced from $f_0$ to $f_0'$ ($>f_0$) as seen in FIG. 10 by an influence of the temperature, then if an ultrasonic oscillator 60 is driven by the resonance frequency $f_0$, then the threshold energy Eth which is a minimum energy necessary to discharge an ink drop becomes very high, resulting in drop of the energy efficiency.

Therefore, in the present embodiment, sweep control is performed, upon discharging of an ink drop, by the CPU 300 such that, for example as seen in FIG. 11, the frequency of ultrasonic waves (output of the PLL-VCO 307) is varied from a frequency $f_L$ to another frequency $f_H$ within the range of frequency from $f_L$ to $f_H$ centered at the standard resonance frequency.

Consequently, even if the condition of the ink varies to vary the optimum resonance frequency at which the energy efficiency is highest for discharging of an ink drop, ultrasonic waves of the optimum resonance frequency can be grasped with certainty and are emitted from the ultrasonic oscillators 60. Accordingly, an ink drop can be discharged with certainty without depending upon the condition of the ink and stabilized ultrasonic printing can be achieved.

In this instance, if the variation rate of the frequency of ultrasonic waves (the sweep rate) is raised (the slope is great) as seen in FIG. 11, then the amount of energy to be supplied to the ink by emission of the ultrasonic waves is decreased. On the contrary if the variation rate of the frequency of ultrasonic waves is lowered (the slope is small), the time for which energy is applied to ink is increased, and a greater amount of energy is supplied to the ink by emission of the ultrasonic waves.

Figure 45:
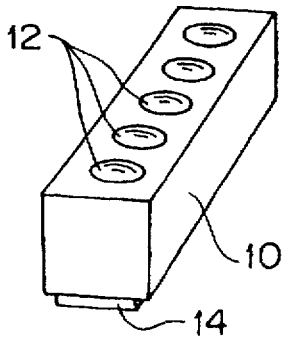
FIG. 45 PRIOR ART
FIG. 45 is a perspective view showing a known recording head for an ultrasonic printer.
Figure 46:
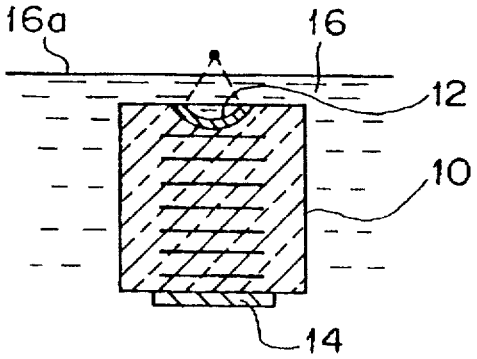
FIG. 46 PRIOR ART
FIG. 46 is an enlarged sectional view showing the recording head of FIG. 45 disposed in ink.
Figure 47:
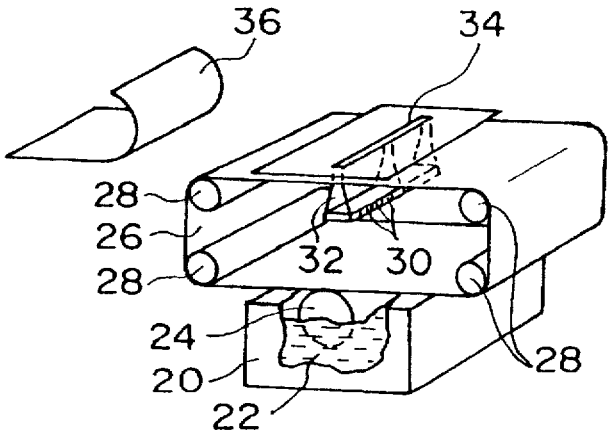
FIG. 47 PRIOR ART
FIG. 47 is a schematic perspective view, partly broken, showing another known ultrasonic printer.

It is to be noted that the sweep control of the frequency of ultrasonic waves described above can be applied not only to ultrasonic printing of the phased array type but similarly to ultrasonic printing of, for example, such another type wherein one dot is recorded by means of one ultrasonic oscillator as shown in FIGS. 45 and 46, and also in this instance, similar advantages to those described above can be achieved.

Further, in the ultrasonic printer 100 of the present embodiment, a specific contrivance is involved also in the arrangement direction of the recording head 200. In particular, in the present embodiment, the recording head 200 is disposed such that, as seen in FIG. 12, the arrangement direction of the ultrasonic oscillators 60 (the longitudinal direction of the recording head 200) is inclined by a predetermined angle with respect to the dot line direction (leftward and rightward direction in FIG. 12) perpendicular to the transportation direction of the recording paper 50 (the upward direction in FIG. 12).

Here, as described hereinabove, the CPU 300 of the ultrasonic printer 100 of the present embodiment (refer to FIG. 6) has a function as a control circuit which controls the ultrasonic oscillators 60 of the recording head 200 so that they are driven at a time to discharge a plurality of ink drops at a time from the recording head 200 to form a plurality of dots at a time on the recording paper 50 such that they do not interfere with each other as described hereinabove.

Figure 12:
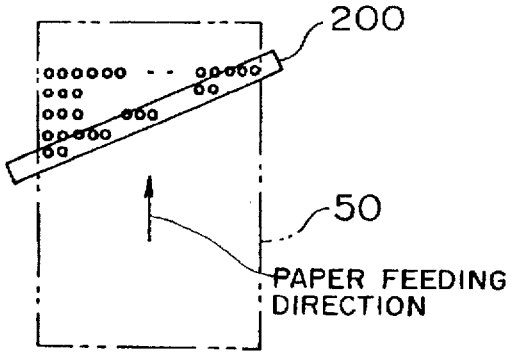
FIG. 12 is a plan view showing an arrangement of the recording or print head in the ultrasonic printer shown in FIG. 3.
Figure 13:
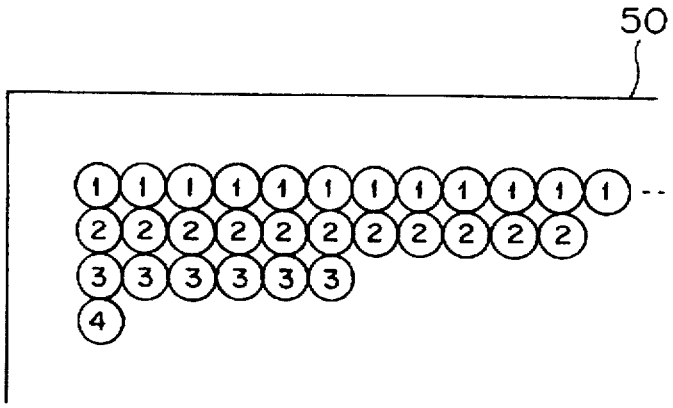
FIG. 13 is a diagrammatic view showing an example of recorded dots obtained by the recording head of the arrangement shown in FIG. 12.
Figure 14:
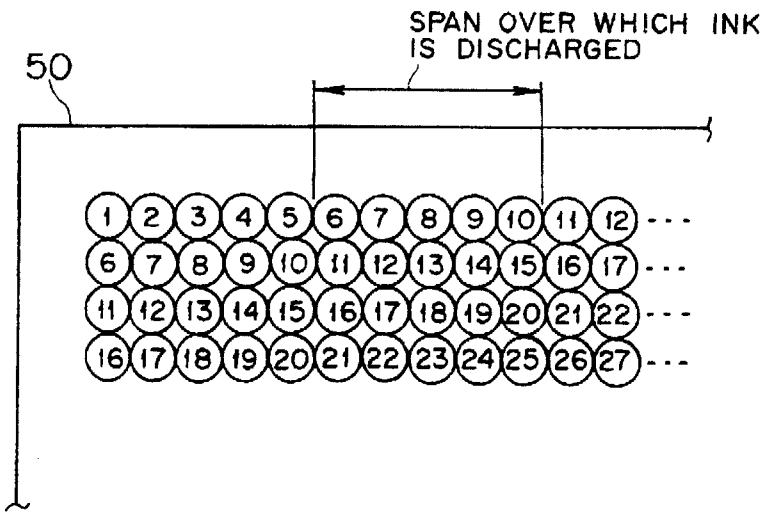
FIG. 14 is a diagrammatic view illustrating printing timings when the recording head is arranged as shown in FIG. 12.

Then, the CPU 300 which performs such control as just described has a function of controlling driving of the ultrasonic oscillators 60 such that, where the recording head 200 is disposed in such an inclined relationship as seen in FIG. 12, ink drops to form dots in a same dot column are discharged to the recording paper 50, which is fed at a fixed speed, at time intervals equal to a value obtained by multiplying the number of dots (in the example shown in FIG. 14, 5 dots) corresponding to the distance between dots formed at a time (a span in which ink drops can be discharged without causing interference with each other) by the discharging period of ink drops.

Where the recording head 200 is disposed in an inclined relationship by a predetermined angle with respect to the dot line direction as described above and the ultrasonic oscillators 60 are controlled to be driven in such a manner as described above by the CPU 300, when adjacent dots are successively recorded while moving the recording paper 50, the adjacent dots are recorded on a same straight line in the dot line direction on the recording paper 50 as seen in FIGS. 13 and 14.

Accordingly, when, for example, a line of a framework such as a table is to be recorded, the framework line can be drawn as a straight line having a fine profile in the dot line direction. Consequently, the print quality can be improved very much.

It is to be noted that, in FIG. 13, each mark ○ represents a dot, and the numeral in each mark ○ represents to which numbered dot line the dot belongs. Further, also in FIG. 14, each mark ○ represents a dot, but the numeral in each mark ○ represents in what numbered printing cycle the ink dot is discharged, and dots of a same numeral are discharged at the same time.

The CPU 300 of the ultrasonic printer 100 of the present embodiment (refer to FIG. 6) further has a function as a control circuit which controls, when next discharging of another ink drop successively after discharging of an ink drop is to be performed, the driving condition of each ultrasonic oscillator 60 in response to the position of the ink level which is detected by the level sensor 306 and is moved by residual oscillations of the ink level to control the energy of an ultrasonic wave to be emitted subsequently.

For example, the CPU 300 in the present embodiment controls the driving condition of each of the ultrasonic oscillators 60 so that, when the position of the ink level becomes lower than that in a stable condition by an residual oscillation of the ink level after discharging of an ink drop, the ultrasonic oscillator 60 may emit a converging ultrasonic wave (burst wave) having an energy insufficient to discharge an ink drop to the ink 240 at the same ink drop discharging position as that in the preceding ink drop discharging period.

An example of the condition and the height of the ink level and the driving waveform of an ultrasonic oscillator by such control as described above is illustrated in FIGS. 15(*a*), 15(*b*) and 15(*c*), respectively.

Figures 15A, 15B, 15C:
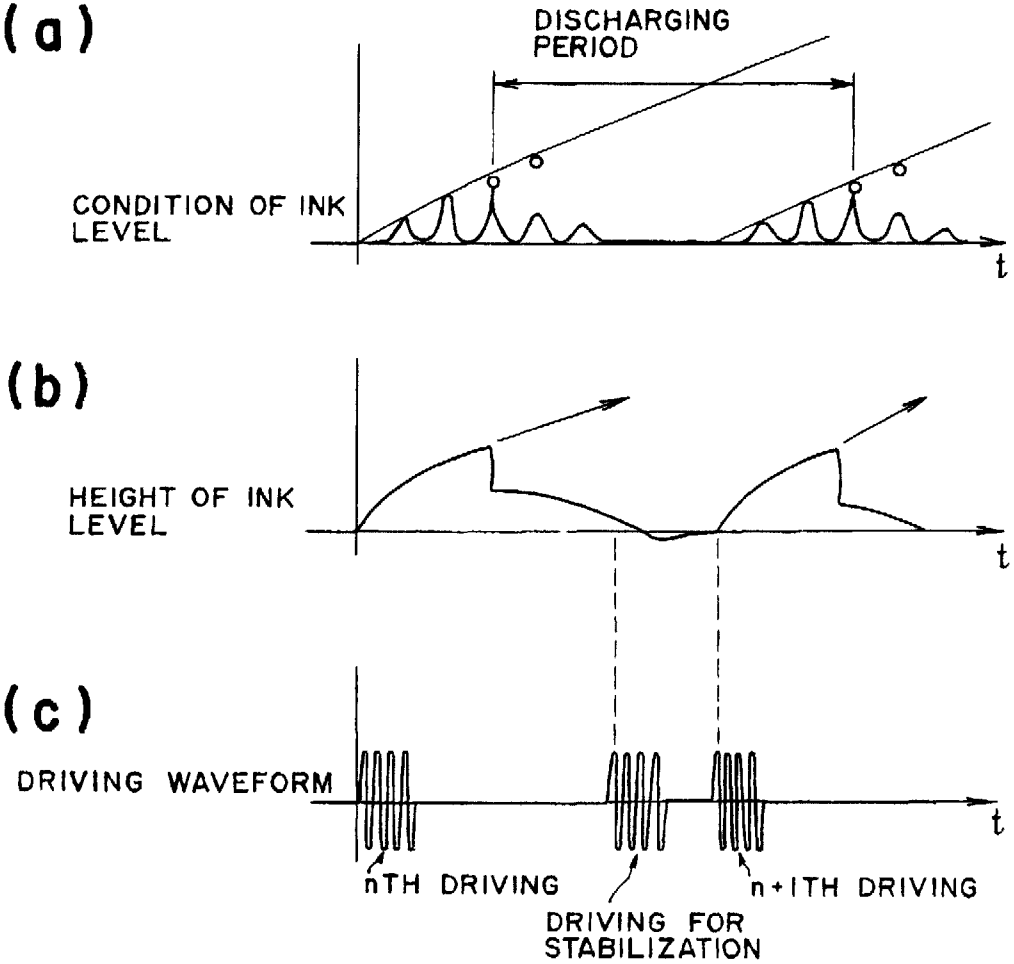
FIGS. 15(*a*) to 15(*c*) are graphs illustrating an example of a condition and a height of an ink level and a driving waveform for an ultrasonic oscillator, respectively, when the ultrasonic printer shown in FIG. 3 performs ink level stabilization control.

If nth driving is performed for the ultrasonic oscillator 60 as seen in FIG. 15(*c*), then the ink level first swells gradually, and then a drop of the ink is separated from the ink and discharged as seen in FIGS. 15(*a*) and 15(*b*).

After the separation of the ink drop, the ink level drops rapidly. However, in the present embodiment, upon such drop of the ink level, the ultrasonic oscillator 60 is driven to emit a burst wave having energy insufficient to discharge an ink drop, and consequently, the ink level can be stabilized compulsorily as seen in FIG. 15(*c*).

Figures 51A, 51B, 51C:
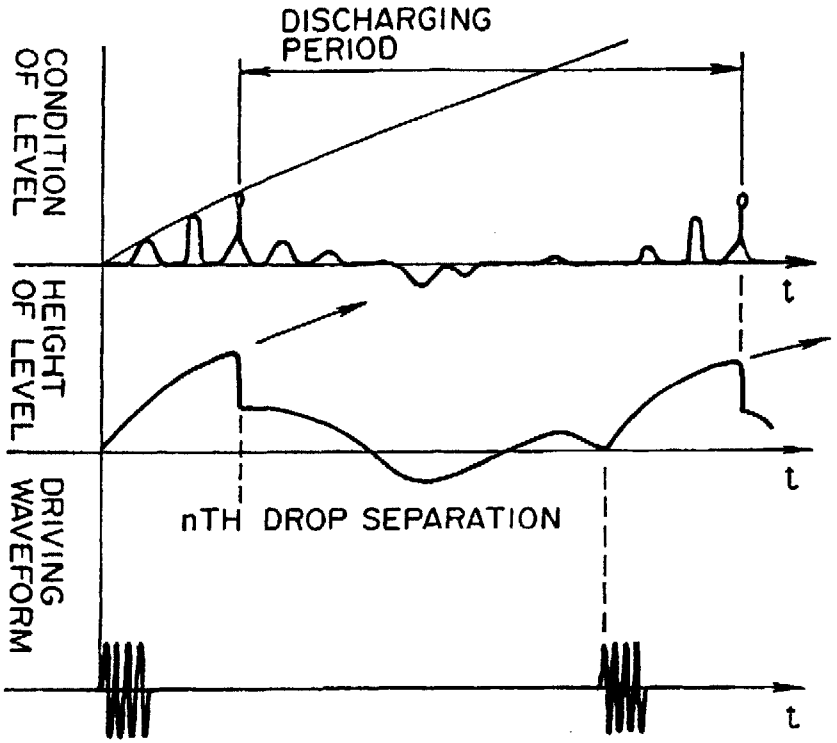
FIG.51(a) PRIOR ART
FIG.51(b) PRIOR ART
FIG.51(c) PRIOR ART
FIGS. 51(*a*) to 51(*c*) are graphs illustrating an example of a condition and a height of an ink level and a driving waveform for an ultrasonic oscillator, respectively, when an ink drop is discharged in an ordinary ultrasonic printer.
Figure 52:
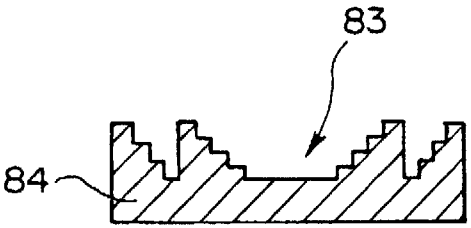
FIG. 52 RELATED ART
FIG. 52 is an enlarged sectional view showing an acoustic Fresnel lens for a linear array head formed by etching.

Consequently, as apparent also from comparison with the example described hereinabove with reference to FIG. 51, since the residual oscillations are controlled to accelerate quieting of the ink level, next n+1th driving (discharging of an ink drop) can be performed at a timing by which a desired resolution can be obtained.

Further, the CPU 300 in the present embodiment controls the driving condition of each of the ultrasonic oscillators 60 so that, when the position of the ink level is higher than that in a stable condition, the ultrasonic oscillator may emit to the ink 240 a converging ultrasonic wave having energy lower than the energy to be applied when the ink level is stable, but when the position of the ink level is lower than the position in the stable condition, the ultrasonic oscillator 60 may emit to the ink 240 a converging ultrasonic wave having energy higher than the energy to be applied when the ink level is stable.

Such driving control as just described is used when successive ink drop discharging is performed at a timing earlier than that of the example described hereinabove with reference to FIGS. 15(*a*) to 15(*c*), that is, the example wherein next ink drop discharging is performed after compulsory stabilization of the ink level.

Figure 16A:
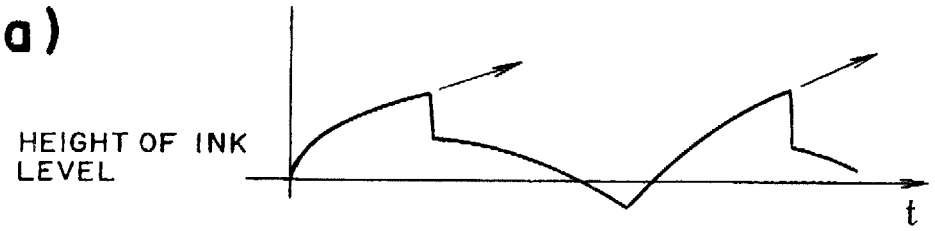
FIGS. 16(*a*) and 16(*b*) and FIGS. 17(*a*) and 17(*b*) are graphs illustrating different examples of the height of the ink level and the driving waveform for the ultrasonic oscillator, respectively, when the ultrasonic printer shown in FIG. 3 performs ink drop successive discharging control.
Figure 16B:
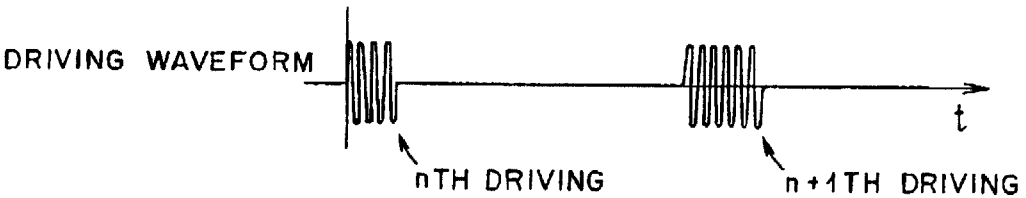

When next ink drop discharging is performed before the ink level drops to its position in its stable condition after discharging of an ink drop as seen in FIG. 16(*a*), the relevant ultrasonic oscillator 60 is driven based on a result of detection of the level sensor 306 so that energy necessary to discharge an ink drop from the ink level position then as seen in FIG. 16(*b*) may be applied.

Figures 17A, 17B:
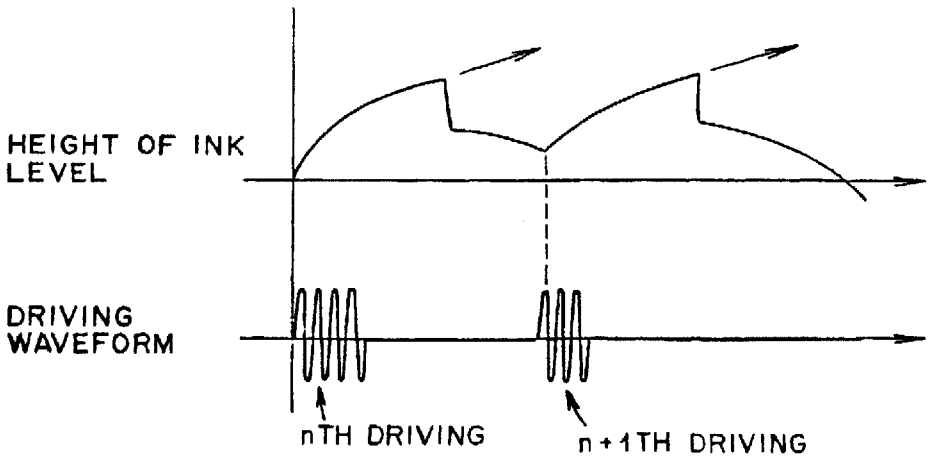

Further, when a next ink drop is to be discharged directly in a condition wherein the ink level drops to a condition lower than that in its stable condition after discharging of an ink drop as seen in FIG. 17(*a*), the ultrasonic oscillator 60 is driven based on a result of detection of the level sensor 306 so that energy obtained by adding, to energy necessary for ordinary discharging of an ink drop, energy necessary to raise the ink level from its ink level position then to the position in its stable condition may be applied as seen in FIG. 17(*b*).

Where a converging ultrasonic wave having energy corresponding to the position of the ink level during movement of the ink level caused by residual oscillations of the ink level is emitted to the ink to performing discharging of an ink drop as seen in FIGS. 16 and 17, discharging of ink drops can be performed successively without waiting until the ink level becomes stabilized.

It is to be noted that, while, in the present embodiment, the energy to be applied to the ink 240 is controlled by the emission time of ultrasonic waves from the ultrasonic oscillators 60 (the driving time of the ultrasonic oscillators 60), it may be controlled alternatively by the voltage to be applied to the ultrasonic oscillators 60.

Further, while, in the embodiment described above, the position of the ink level is detected by the level sensor 306, the position of the ink level may alternatively be discriminated in accordance with the discharging interval between ink drops, and the discharging timing of burst waves for stabilization of the ink level or the energy for discharging of an ink drop to be applied to the ink 240 may be determined based on the position of the thus discriminated ink level.

Figure 18:
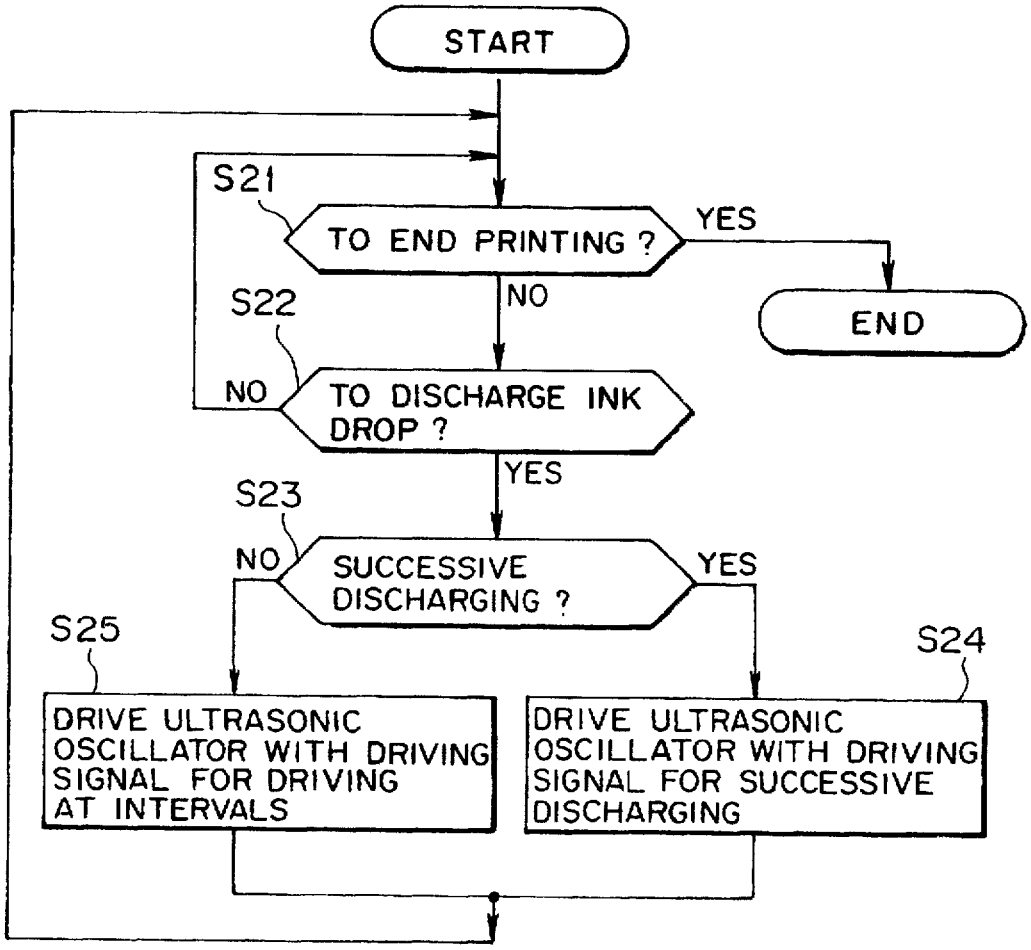
FIG. 18 is a flow chart illustrating controlling operation of a CPU when the ultrasonic printer shown in FIG. 3 performs ink drop successive discharging control.

Operation of the CPU 300 which performs adjustment of energy upon successive discharging of ink drops as described above will be described briefly with reference to the flow chart (steps S21 to S25) shown in FIG. 18.

First, it is discriminated whether or not printing should be ended (step S21). If printing should not be ended (if the discrimination is NO), then it is discriminated whether or not an ink drop should be discharged (step S22). When an ink drop should not be discharged (when the discrimination is NO), the control sequence returns to step S21, but on the contrary when an ink drop should be discharged (when the discrimination is YES), it is discriminated whether or not an ink drop should be discharged successively (step S23).

When successive discharging should be performed (when the discrimination is YES), the CPU 300 controls driving of the ultrasonic oscillators (piezoelectric elements) 60 by way of driving signals for successive discharging (step S24). In particular, the CPU 300 adopts one of the method described hereinabove with reference to FIG. 15, that is, the method wherein next ink drop discharging is performed after compulsory stabilization of the ink level is performed, and the other method described hereinabove with reference to FIGS.

16 and 17, that is, the method wherein energy is applied in response to the position of the ink level to discharge an ink drop.

On the other hand, when it is discriminated at step S23 that successive discharging should not be performed (when the discrimination is NO), the CPU 300 controls driving of the ultrasonic oscillators 60 by driving signals for use for discharging of ink drops at intervals, that is, in the usual method (step S25).

In this manner, by making use of the control function of the CPU 300 to compulsorily suppress residual oscillations of the ink level caused by discharging of an ink drop to stabilize the ink level or to emit converging ultrasonic waves having energy corresponding to the position of the ink level during movement of the ink level by residual oscillations to the ink 240 to discharge an ink drop, discharging of ink drops can be performed successively without waiting until the ink level becomes stabilized, and consequently, the discharging period of ink drops can be reduced remarkably, which contributes very much to an increase in speed and resolution of ultrasonic printing.

It is to be noted that also the driving control for successive discharging described above (or for stabilization of the ink level) can be applied not only to ultrasonic printing of the phased array type but also to ultrasonic printing of, for example, such another type wherein one dot is recorded by means of one ultrasonic oscillator as shown in FIGS. 45 and 46, and also in this instance, similar advantages to those described above can be achieved.

By the way, while the recording head 200 in the embodiment described above is constructed such that, as shown in FIG. 3, the ink reservoir 230 is located on the acoustic cylindrical lens 220 formed on the acoustic medium 210, such other recording heads 200A as shown, for example, in FIGS. 19 to 24, 26 and 27 can be used alternatively.

Figure 19:
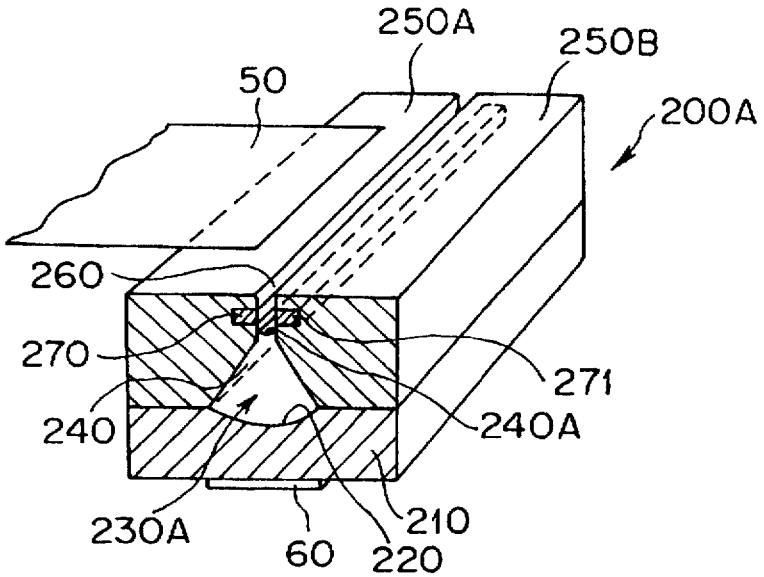
FIG. 19 is a cross sectional perspective view showing an another recording head which can be employed in the ultrasonic printer shown in FIG. 3.
Figure 20:
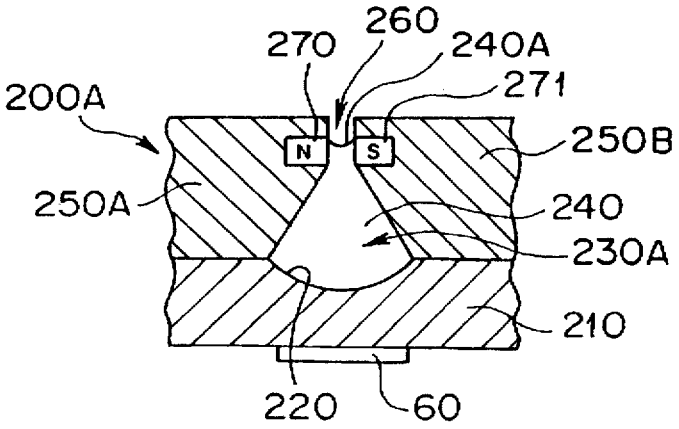
FIG. 20 is an enlarged cross sectional view of the recording head shown in FIG. 19.

Referring first to FIGS. 19 and 20, one of the recording heads 200A is shown in cross sectional perspective view and in enlarged cross sectional view, respectively. Also the recording head 200A shown in FIGS. 19 and 20 has a similar construction to the recording head 200 shown in FIG. 3 in that an acoustic cylindrical lens 220 is formed on an upper face of an acoustic medium 210 and a plurality of ultrasonic oscillators 60 are arranged and fixedly mounted on a lower face of the acoustic medium 210.

A pair of ink reservoir forming members 250A and 250B are secured to the upper face of the acoustic medium 210 in such a manner as to cover the acoustic cylindrical lens 220 from the opposite sides and from above so that an ink reservoir 230A having a sectoral cross section is formed along the longitudinal direction of the recording head 200A above the acoustic cylindrical lens 220.

Further, at the top of the ink reservoir 230A of the sectoral cross section (between the members 250A and 250B), a slit-like opening 260 is formed at the converging position of ultrasonic waves from the acoustic cylindrical lens 220 along the longitudinal direction of the recording head 200A such that it communicates a space above the recording head 200A in which the recording paper 50 passes and the ink reservoir 230A with each other.

Then, in the present embodiment, the converging point of converging ultrasonic waves from the acoustic cylindrical lens 220 is set so as to be positioned within the opening 260 between the members 250A and 250B, and in order to cause an ink drop to be discharged from the converging point, ink 240 is filled in the ink reservoir 230A such that also the ink level 240A may be positioned within the opening 260. It is to be noted that the ink 240 is supplied into the ink reservoir 230A normally by means of an ink pump not shown from a reservoir tank not shown.

Accordingly, an ink drop discharged from the ink level 240A is released to the outside through the opening 260 and then sticks to the recording paper 50 above the recording head 200A.

Where the recording head 200A of the construction described above is used, in the present arrangement, ink in a magnetized condition, that is, magnetic ink, is used as the ink 240, and a pair of permanent magnets 270 and 271 having different N and S magnetic poles are disposed in an opposing relationship to each other across the opening 260 in the opening 260 in which the ink level 240A is positioned. The permanent magnets 270 and 271 are mounted in an embedded condition on the members 250A and 250B, respectively, and the permanent magnets 270 and 271 form a magnetic field generation section for forming a magnetic field in the opening 260.

Normally, the ink level 240A is held by the surface tension of the ink 240, and depending upon a circumstantial condition of the ink 240 such as a supplying condition or the temperature, the position of the ink level 240A may possibly be fluctuated as described hereinabove.

However, in the present arrangement, the ink level 240A of the ink 240 in a magnetized condition is held at the position of the permanent magnets 270 and 271 in the opening 260 by the magnetic field formed by the permanent magnets 270 and 271. For example, even when an impact is applied to the body of the ultrasonic printer 100, the ink 240 in the proximity of the opening 260 is held by the permanent magnets and will not flow out readily.

In this manner, the ink level 240A can always be held at a suitable position (in the proximity of the converging point of ultrasonic waves) in the opening 260 based on the magnetic field by the permanent magnets 270 and 271, and stabilized discharging of an ink drop and hence stabilized ultrasonic printing can be performed.

Figure 21:
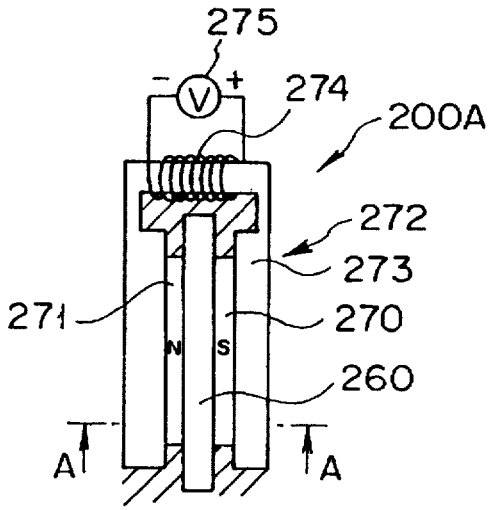
FIG. 21 is a horizontal sectional view schematically showing part of a modified recording head which can be employed in the ultrasonic printer shown in FIG. 3.
Figure 22:
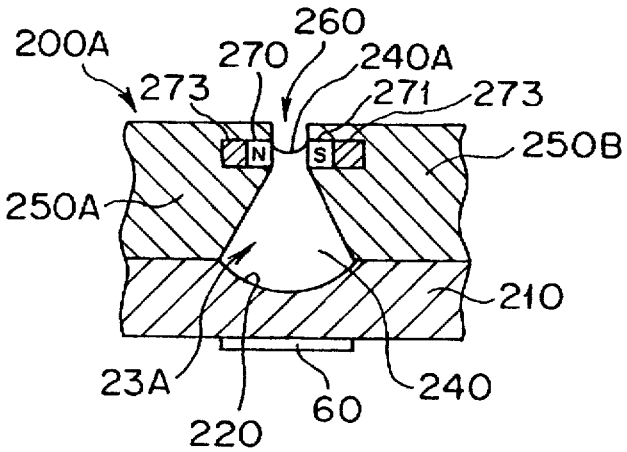
FIG. 22 is a sectional view taken along line A—A in FIG. 21.

FIGS. 21 and 22 show a modification to the recording head 200A described above with reference to FIGS. 19 and 20. Referring to FIGS. 21 and 22, also the modified recording head is denoted at 200A and additionally includes an electromagnet 272 provided on the outer side of the permanent magnets 270 and 271 disposed in the opening 260. It is to be noted that also the ink 240 used here has magnetism.

The electromagnet 272 includes a channel-shaped core 273 made of a magnetic material such as ferrite, a coil 274 wound around a central portion of the core 273, and a power source 275 for supplying power to the coil 274. It is to be noted that on/off switching of the power source 275, that is, the energization of the electromagnet 272, is controlled, for example, by the CPU 300 (refer to FIG. 6).

In the arrangement shown in FIGS. 21 and 22, when power is supplied from the power source 275 to the coil 274 to energize the electromagnet 272, the electromagnet 272 forms a magnetic field which cancels the magnetic field formed by the permanent magnets 270 and 271.

In the structure wherein the permanent magnets 270 and 271 are merely disposed as seen in FIGS. 19 and 20, when an ink drop is to be discharged from the ink level 240A, energy sufficient to prevail over the magnetic force provided by the permanent magnets 270 and 271 must be added to energy for discharging of an ink drop. Further, in such a case that printing is not performed for a long interval of time, since, if the ink level 240A is left in an outwardly exposed condition, the ink 240 in the ink reservoir 230A becomes dry, the ink 240 is returned into a reservoir tank not shown or the like in advance, that is, an ink removing operation is performed in advance. However, with the structure wherein the permanent magnets 270 and 271 are merely disposed as described above, when such an ink removing operation is performed, the ink 240 may possibly remain attracted between the permanent magnets 270 and 271 of the N and S poles.

Therefore, the electromagnet 272 is additionally provided for the permanent magnets 270 and 271 as shown in FIGS. 21 and 22, and upon discharging of an ink drop (at an instant of discharging of an ink drop) or upon an ink removing operation, the electromagnet 272 is energized under the control of the CPU 300 to form a magnetic field which cancels the magnetic field formed by the permanent magnets 270 and 271.

Thus, whereas the ink level 240A is normally held at a suitable position (in the proximity of converging point of ultrasonic waves) in the opening 260 based on the magnetic field formed by the permanent magnets 270 and 271, upon discharging of an ink drop or upon an ink removing operation, the magnetic field is cancelled so that discharging of an ink drop or removal of ink can be performed with certainty without being influenced by the magnetic field.

Figure 23:
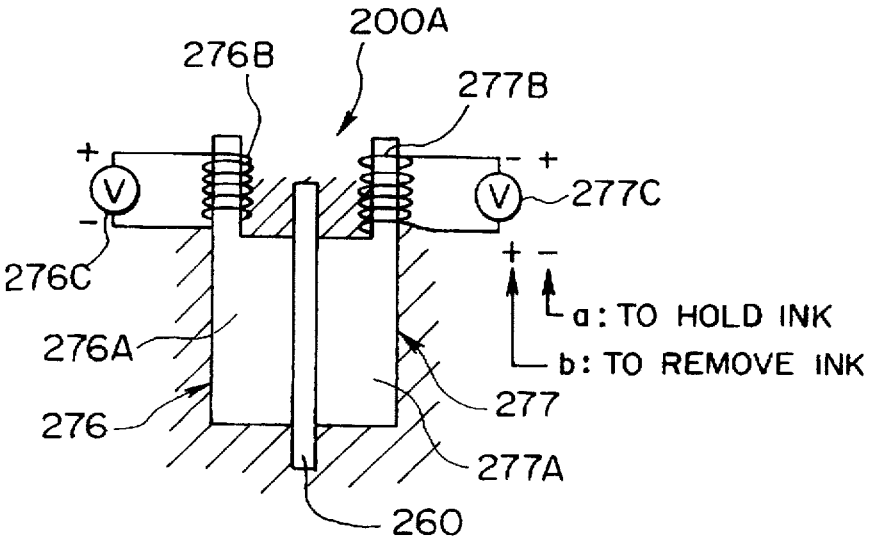
FIG. 23 is a horizontal sectional view schematically showing part of another modified recording head which can be employed in the ultrasonic printer shown in FIG. 3.

FIG. 23 shows another modification to the recording head 200A described hereinabove with reference to FIGS. 19 and 20. Referring to FIG. 23, the recording head is also denoted at 200A and includes a magnetic field generation section formed from a pair of electromagnets 276 and 277 but without employing a permanent magnet. In particular, in the arrangement shown, the electromagnets 276 and 277 in pair are disposed in an opposing relationship to each other across the opening 260 of the recording head 200A, and a magnetic field is formed in the opening 260 by the electromagnets 276 and 277. It is to be noted that also the ink 240 used here is magnetic ink.

Each of the electromagnets 276 and 277 includes a channel-shaped core 276A or 277A made of a magnetic material such as ferrite, a coil 276B or 277B wound around an end portion of the core 276A or 277A, and a power source 276C or 277C for supplying power to the coil 276B or 277B.

It is to be noted that on/off switching of the power sources 276C and 277C and the directions of electric currents to flow through the coils 276B and 277B, that is, the energization conditions of the electromagnets 276 and 277, are controlled, for example, by the CPU 300 (refer to FIG. 6). A control procedure by the CPU 300 including the energization control of the electromagnets 276 and 277 will be hereinafter described with reference to FIG. 25.

Then, when no printing is performed in a condition wherein the ink 240 is stored in the ink reservoir 230A, the energization conditions of the electromagnets 276 and 277 in pair are controlled by the CPU 300 so that different magnetic poles are produced in the electromagnets 276 and 277 to form a magnetic field in the opening 260.

Figure 24:
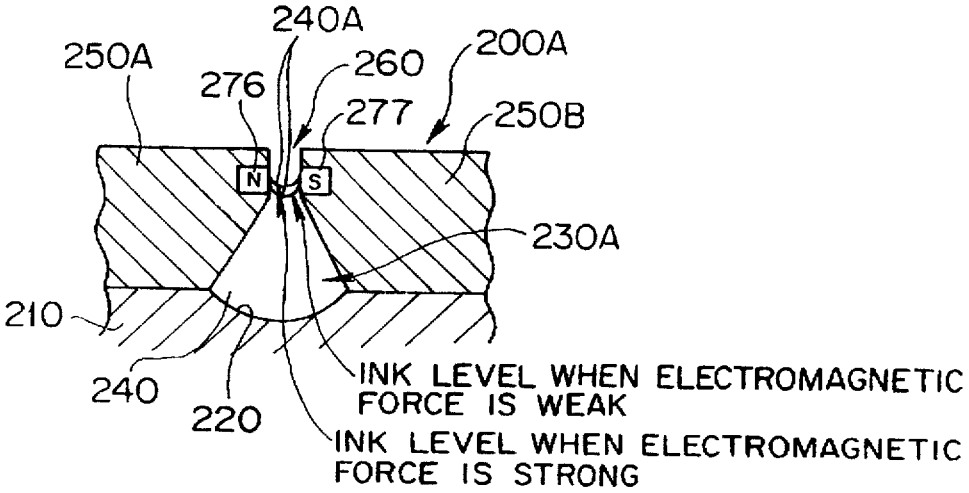
FIG. 24 is a cross sectional view illustrating a relationship between an electromagnetic force and the position of an ink level in the recording head shown in FIG. 23.

In this instance, the height of the ink level 240A in the opening 260 is adjusted in such a manner as seen, for example, in FIG. 24 by the strength of the magnetic field thus formed. In particular, the ink level 240A is located along a line of magnetic force of the magnetic field formed in the opening 260. Thus, the ink level 240A is adjusted to a high position when the electromagnetic force is strong, but is adjusted to a low position when the electromagnetic force is weak, as seen in FIG. 24.

On the other hand, at an instant of discharging of an ink drop or upon an ink removing operation, the power sources 276C and 277C are switched into an off state by the CPU 300 to cancel the energization conditions of the electromagnets 276 and 277 in pair.

Further, upon ink removing operation, the electromagnets 276 and 277 may be controlled such that, not only the energization conditions of the electromagnets 276 and 277 are cancelled, but also the directions of the electric currents to flow through the coils 276B and 277B are switched so that the electromagnets 276 and 277 in pair may generate magnetic fields which repel each other.

It is to be noted that the switching control of the electromagnets 276 and 277 between an attracting condition and a repelling condition is performed, for example, by changing over the direction of an electric current to flow through the coil 277B while the flowing direction of an electric current through the other coil 276B is kept fixed as seen in FIG. 23. In the arrangement shown in FIG. 23, the power source 277C is controlled by the CPU 300 such that, when ink should be held, that is, when the electromagnets 276 and 277 should attract each other, the polarities (±) thereof may be such as indicated by "a" in FIG. 23, but when ink should be removed, that is, when the electromagnets 276 and 277 should repel each other, the polarities (±) thereof may be such as indicated by "b" in FIG. 23.

By such switching operation, whereas the ink level 240A is normally held at the optimum position in the proximity of the converging point of ultrasonic waves in the opening 260 by electromagnetic forces of the electromagnets 276 and 277, energization of the electromagnets 276 and 277 can be stopped, upon discharging of an ink drop or upon ink removing operation, to cancel the magnetic fields to cancel restriction of an ink drop so that discharging of an ink drop or removal of ink can be performed with certainty without being influenced by any magnetic field. Further, upon removal of ink, since the energization conditions of the electromagnets 276 and 277 are controlled so that they repel each other, otherwise possible remaining of the ink 240 in the opening 260 due to a surface tension can be prevented with certainty.

Figure 25:
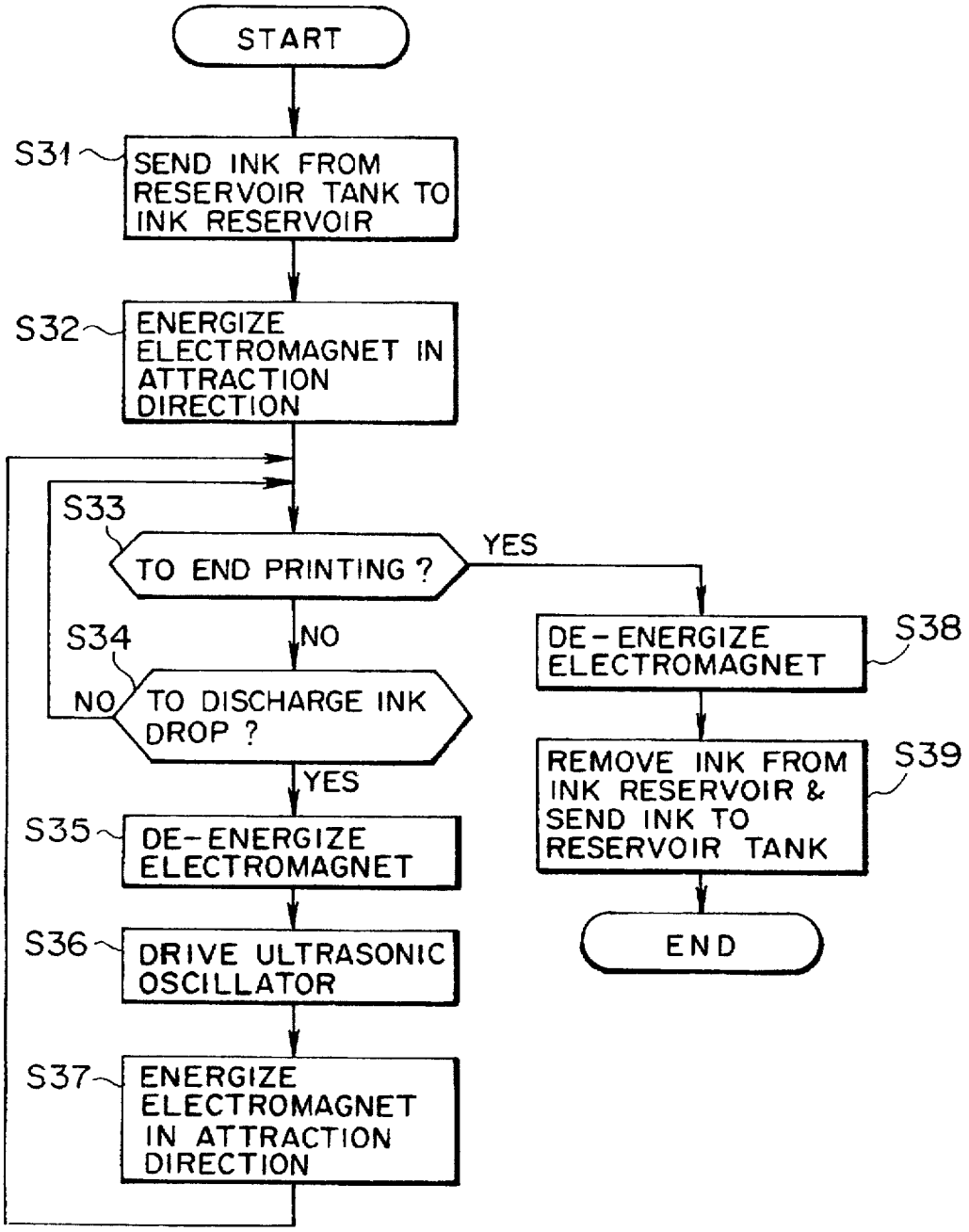
FIG. 25 is a flow chart illustrating controlling operation of the CPU for the recording head shown in FIG. 23.

Subsequently, a control procedure of the CPU 300 performed for the recording head 200A (electromagnets 276 and 277) shown in FIG. 23 will be described with reference to the flow chart (steps S31 to S39) shown in FIG. 25.

Upon starting of ultrasonic printing, the ink 240 is first sent into the ink reservoir 230A from a reservoir tank not shown (step S31), and then the electromagnets 276 and 277 are energized so that they attract each other (step S32). In this instance, the magnetic forces by the electromagnets 276 and 277 are adjusted so that the ink level 240A may be positioned at its optimum position (in the proximity of the converging point of ultrasonic waves) in the opening 260 of the recording head 200A.

Then, it is discriminated whether or not printing should be ended (step S33). If printing should not be ended (when the discrimination is NO), then it is discriminated whether or not an ink drop should be discharged (step S34). If an ink drop should not be discharged (when the discrimination is NO), then the control sequence returns to step S33, but if an ink drop should be discharged (when the discrimination is YES), then the CPU 300 switches off the power sources 276C and 277C to de-energize the electromagnets 276 and 277 (step S35) and then controls driving of the ultrasonic oscillators 60 so that an ink drop is discharged from the ink level 240A (step S36). Thereafter, the electromagnets 276 and 277 are energized in a direction in which they attract each other (step S37), and then the control sequence returns to step S33.

On the contrary if it is discriminated at step S33 that printing should be ended (when the discrimination is YES), then the CPU 300 either switches off the power sources 276C and 277C to de-energize the electromagnets 276 and 277 or energizes the electromagnets 276 and 277 in a direction in which they repel each other as described hereinabove (step S38). Then, the ink 240 is removed from the ink reservoir 230A and sent to the reservoir tank (step S39), thereby ending the processing.

Figure 26:
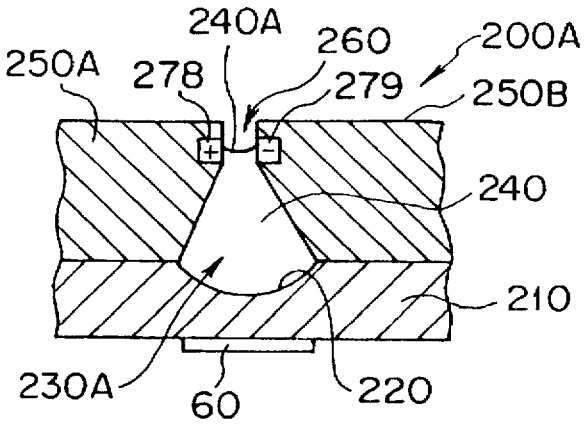
FIG. 26 is a cross sectional view schematically showing part of a further modified recording head which can be employed in the ultrasonic printer shown in FIG. 3.

FIG. 26 schematically shows in plan view part of a further modification to the recording head 200A described hereinabove with reference to FIGS. 19 and 20. Referring to FIG. 26, the modified recording head is also denoted at 200A and includes, in place of the magnetic field generation section, an electric field generation section including a pair of electrodes 278 and 279 which form an electric field in the opening 260. In particular, in the arrangement shown in FIG. 26, the electrodes 278 and 279 in pair are disposed in an opposing relationship to each other across the opening 260 of the recording head 200A, and an electric field is formed in the opening 260 by producing a difference in potential between the electrodes 278 and 279.

In the recording head 200A shown in FIG. 26, fluid having electro-viscosity, that is, electro-reologocal (ER) fluid, is employed for the ink 240. The ER fluid has a viscosity which can be controlled by a voltage and has such a property that, as a potential difference applied increases, the viscosity of the fluid increases, in some cases, to such a degree that the fluid almost acts as a solid.

A power source not shown is connected to the electrodes 278 and 279, and the potential difference between the electrodes 278 and 279 is controlled, for example, by the CPU 300 (refer to FIG. 6). A control procedure of the CPU 300 including the control of the potential difference between the electrodes 278 and 279 will be hereinafter described with reference to FIG. 28.

When printing is not performed in a condition wherein the ink 240 is kept accommodated in the ink reservoir 230A, the energization condition of the electrodes 278 and 279 in pair is controlled by the CPU 300 so as to produce a potential difference between the electrodes 278 and 279 to form an electric field in the opening 260.

Figure 27:
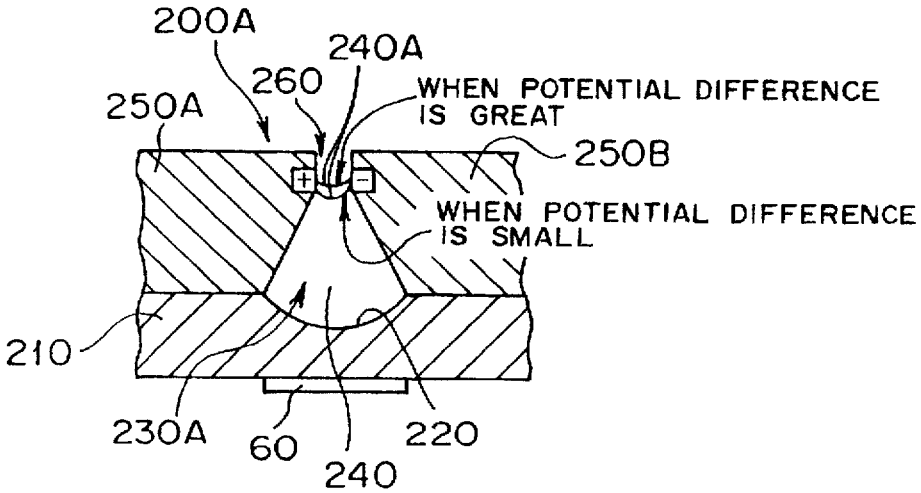
FIG. 27 is a similar view but illustrating a relationship between a potential difference and the position of an ink level in the recording head shown in FIG. 26.

In this instance, the height of the ink level 240A in the opening 260 is adjusted, for example, as seen in FIG. 27 by the strength of the electric field thus formed by the electrodes 278 and 279. In particular, the ink level 240A is disposed along a line of electric force of the electric field formed in the opening 260, and the position of the ink level 240A is adjusted to a high position when the potential difference is great, but to a low position when the potential difference is small, as seen in FIG. 27.

On the other hand, at an instant when an ink drop is to be discharged or upon an ink removing operation, the CPU 300 switches off the power source to de-energize the electrodes 278 and 279 in pair.

Consequently, whereas the ink level 240A is normally held in its optimum position in the proximity of the converging point of ultrasonic waves in the opening 260 by the potential difference between the electrodes 278 and 279, when an ink drop is to be discharged or when the ink is to be removed, the energization is stopped to eliminate the electric field to cancel restriction of an ink drop so that discharging of an ink drop or an ink removing operation can be performed with certainty without being influenced by any electric field.

Figure 28:
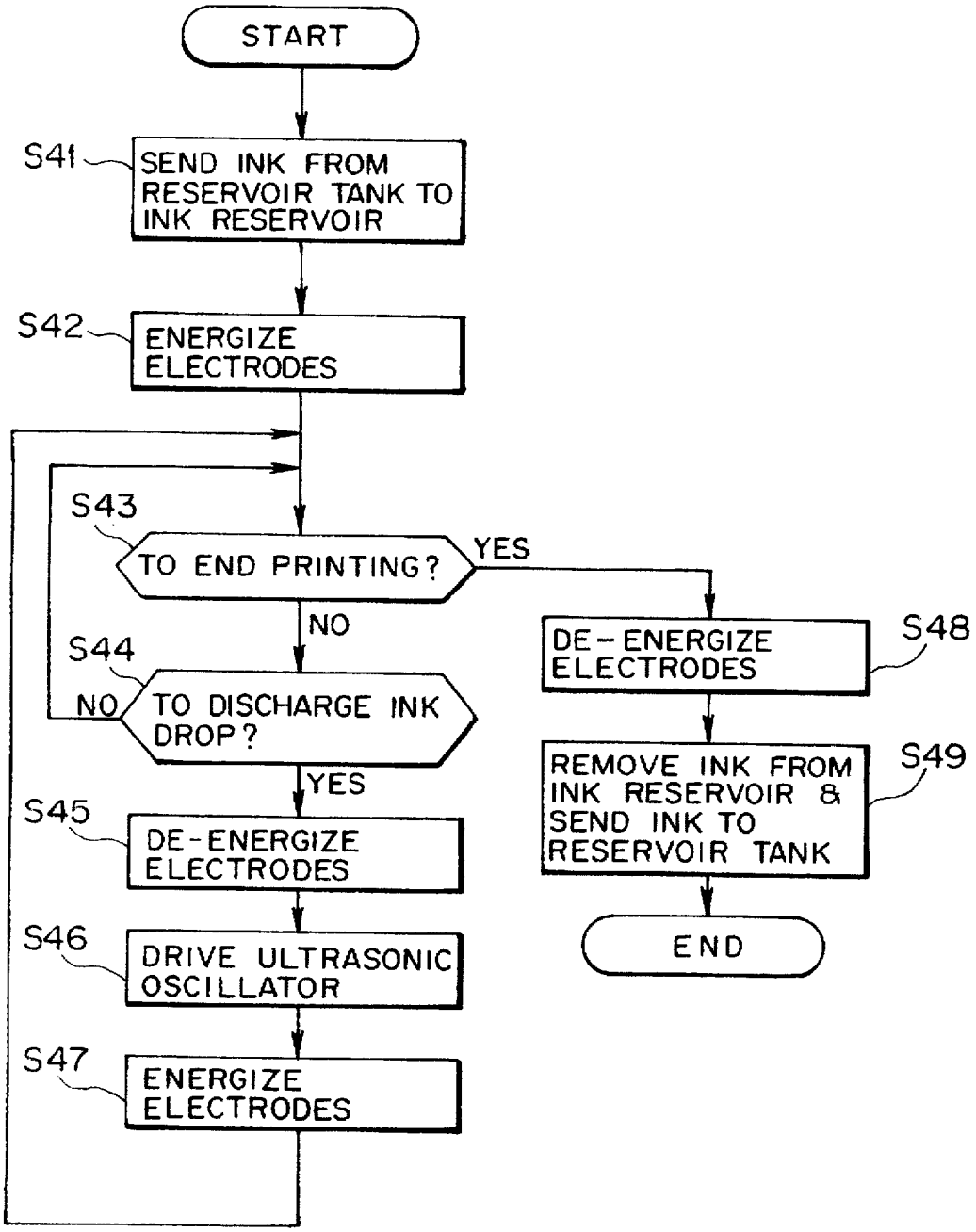
FIG. 28 is a flow chart illustrating controlling operation of the CPU for the recording head shown in FIG. 26.

Subsequently, the control procedure of the CPU 300 performed for the recording head 200A (electrodes 278 and 279) shown in FIG. 26 will be described with reference to the flow chart (steps S41 to S49) shown in FIG. 28.

Upon starting of ultrasonic printing, the ink 240 is first sent into the ink reservoir 230A from a reservoir tank not shown (step S41), and then the electrodes 278 and 279 are energized to produce a potential difference between the electrodes 278 and 279 to form an electric field in the opening 260 (step S42). In this instance, the potential difference between the electrodes 278 and 279 is adjusted so that the position of the ink level 240A in the opening 260 of the recording head 200A may be positioned at its optimum position in the proximity of the converging point of ultrasonic waves.

Then, it is discriminated whether or not printing should be ended (step S43), and if printing should not be ended (when the discrimination is NO), it is discriminated whether or not an ink drop should be discharged (step S44). If an ink drop should not be discharged (when the discrimination is NO), the control sequence returns to step S43, but on the contrary if an ink drop should be discharged (when the discrimination is YES), the CPU 300 switches off the power source to de-energize the electrodes 278 and 279 (step S45) and then controls driving of the ultrasonic oscillators 60 so that an ink drop is discharged from the ink level 240A (step S46). Thereafter, a potential difference is produced between the electrodes 278 and 279 again (step S47), and then the control sequence returns to step S43.

On the contrary if it is discriminated at step S43 that printing should be ended (when the discrimination is YES), the CPU 300 switches off the power sources 276C and 277C to de-energize the electrodes 278 and 279 (step S48). Then, the ink 240 is removed from the ink reservoir 230A and sent to the reservoir tank (step S49), thereby ending the processing.

For the recording head in the present embodiment, not only the recording head 200 shown in FIG. 3 and the recording heads 200A shown in FIGS. 19 to 24, 26 and 27, but also, for example, such recording heads 200B as shown FIGS. 29 to 33 can be employed.

Figure 29:
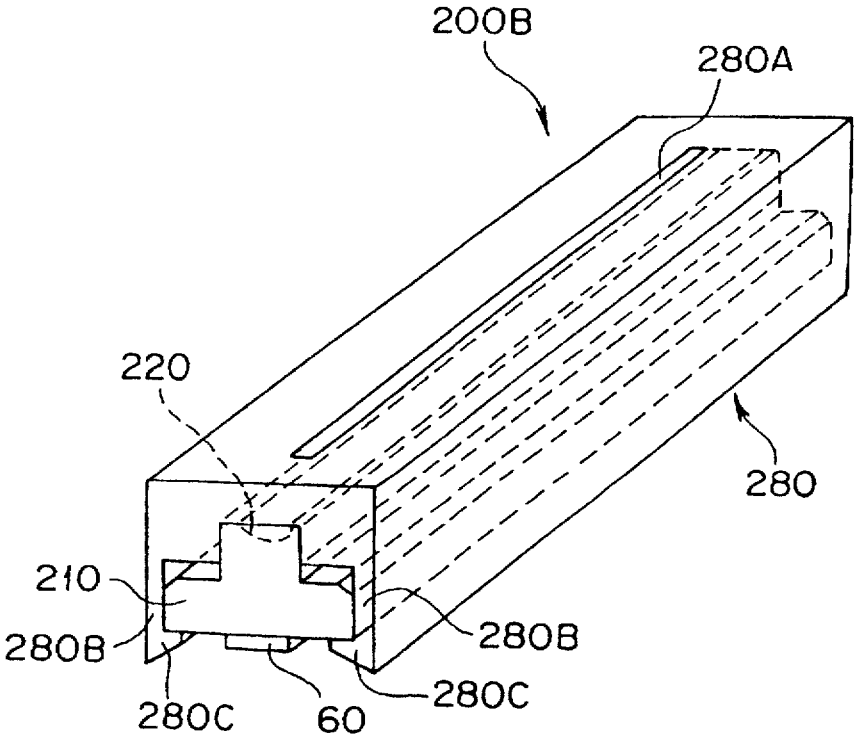
FIG. 29 is a perspective view showing an entire construction of a further recording head which can be employed in the ultrasonic printer shown in FIG. 3.

FIG. 29 shows in perspective view an entire construction of one of such recording heads 200B, and FIGS. 30 to 33 show in cross sectional view different examples of a detailed construction of the recording head 200B shown in FIG. 29.

Referring first to FIG. 29, the entire construction of the recording head 200B will be described. The recording head 200B shown includes an acoustic medium 210 formed on an upper face of an acoustic cylindrical lens 220, which is similar to that of the recording head 200 or recording heads 200A described hereinabove, but does not include such an ink reservoir as described hereinabove. Thus, with the recording head 200B, an ink cartridge 280 is attached to the acoustic medium 210 so that ink may be supplied from the ink cartridge 280. In other words, the recording head 200B is formed from the acoustic medium 210, and the ink cartridge 280 removably mounted on the acoustic medium 210.

As hereinafter described with reference to FIGS. 30 to 33, ink 240 is contained in the ink cartridge 280, and the ink cartridge 280 has an opening (nozzle) 280A in the form of a slit formed therein along a converging position of ultrasonic waves from the acoustic cylindrical lens 220 such that it forms therein an ink level 240A from which an ink drop can be discharged to the outside. In the opening 280A, the ink level 240A is held by a surface tension and exposed to the outside. It is to be noted that, similarly to the recording heads 200 and 200A described hereinabove, a plurality of ultrasonic oscillators (piezoelectric elements) 60 are arranged and securely mounted on a bottom face of the acoustic medium 210.

The ink cartridge 280 has a gate-shaped cross section (section perpendicular to the longitudinal direction of the ink cartridge 280) such that, as seen also from FIGS. 30 to 33, it holds the acoustic medium 210 from the opposite sides. Thus, the ink cartridge 280 has a pair of side walls 280B extending from a body portion thereof along the opposite sides of the acoustic medium 210, and a pair of pawl portions 280C are formed at the ends of the side walls 280B such that they are engaged with the bottom face of the acoustic medium 210, that is, the face of the acoustic medium 210 opposite to the face on which the acoustic cylindrical lens 220 is formed.

As the pawl portions 280C are engaged with the bottom face of the acoustic medium 210, the ink cartridge 280 is secured to the acoustic medium 210, thereby forming the recording head 200B as a unitary member of the ink cartridge 280 and the acoustic medium 210.

Subsequently, different examples of the construction of the recording head 200B (ink cartridge 280) will be successively described in detail with reference to FIGS. 30 to 33.

Figure 30:
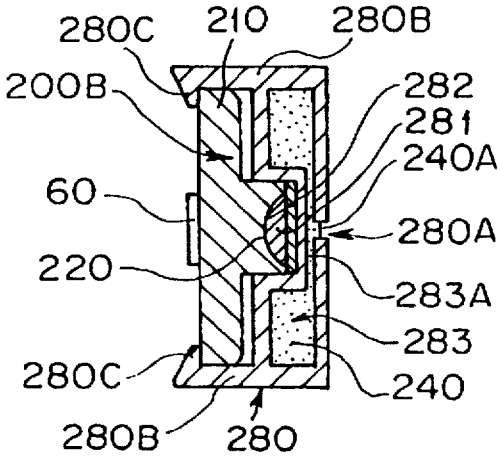
FIG. 30 is a cross sectional view showing a detailed construction of the recording head shown in FIG. 29.

Referring first to FIG. 30, the recording head 200B shown is constructed particularly such that a filler 281 is filled in the acoustic cylindrical lens 220 of the acoustic medium 210, and a face of the recording head 200B which is to be contacted with the ink cartridge 280 is formed as a flat face.

While the ink cartridge 280 is mounted in a closely contacting condition on the ink cartridge side surface in the form of a flat face of the acoustic medium 210, in the arrangement shown in FIG. 30, an intermediate layer 282 is interposed between the acoustic medium 210 and the ink cartridge 280. It is to be noted that the intermediate layer 282 may be adhered to the acoustic medium 210 side or to the ink cartridge 280 side.

A resilient member such as a rubber member is used for the intermediate layer 282 so that an air layer is formed between the acoustic medium 210 (filler 281) and the ink cartridge 280 by the intermediate layer 282 to prevent otherwise possible acoustic incompatibility between them.

Further, the intermediate layer 282 is formed from a member which has an intermediate acoustic impedance $Z_m$ between the acoustic impedance $Z_1$ of the acoustic medium 210 side and the acoustic impedance $Z_2$ of the ink cartridge 280 side (for example, $Z_m=(Z_1 \cdot Z_2)^{1/2}$). Furthermore, the intermediate layer 282 is formed such that it has a thickness set equal to an odd number of times the quarter wavelength of ultrasonic waves emitted from the acoustic cylindrical lens 220, usually to the thickness equal to the quarter wavelength. Where the material and the thickness of the intermediate layer 282 are set in this manner, ultrasonic waves are propagated efficiency (theoretically all ultrasonic waves are propagated) from the acoustic medium 210 side to the ink 240 in the ink cartridge 280.

Further, an ink tank 283 is formed in the ink cartridge 280 and filled with the ink 240. A portion of the ink tank 283 between the acoustic cylindrical lens 220 and the opening 280A is formed as a narrow ink supply path 283A so that, even if the amount of ink in the ink tank 283 decreases, the ink 240 is supplemented up to the position of the opening 280A by way of the ink supply path 283A by the surface tension of the ink 240.

Also where the recording head 200B constructed with the ink cartridge 280 mounted thereon is used, ultrasonic waves generated by driving of the ultrasonic oscillators 60 are transmitted in the acoustic medium 210 and refracted at the position of the acoustic cylindrical lens 220 so that they are converged in the proximity of the ink level 240A positioned in the opening 280A of the ink cartridge 280. Consequently, an ink drop from the converging point is discharged to the outside through the opening 280A and sticks to recording paper 50 passing in the very proximity of the recording head 200B so that a dot is recorded on the recording paper 50.

As described above, where the ink cartridge 280 described above is used, the ink 240 can be supplemented or supplied very readily by replacement of the ink cartridge 280 without provision of a complicated ink supplying mechanism or structure such as a pump for ink or a power source for such pump. Consequently, the structure of the ultrasonic printer 100 can be simplified very much.

Further, in this instance, where the acoustic impedance and the thickness of the intermediate layer 282 between the acoustic medium 210 and the ink cartridge 280 are set to suitable values, ultrasonic waves from the acoustic medium 210 side can be transmitted with certainty to the ink 240 in the ink cartridge 280, and consequently, although a cartridge is employed to supply ink, discharging of an ink drop can be performed with certainty.

Subsequently, the modifications to the recording head 200B described above will be described.

Figure 31:
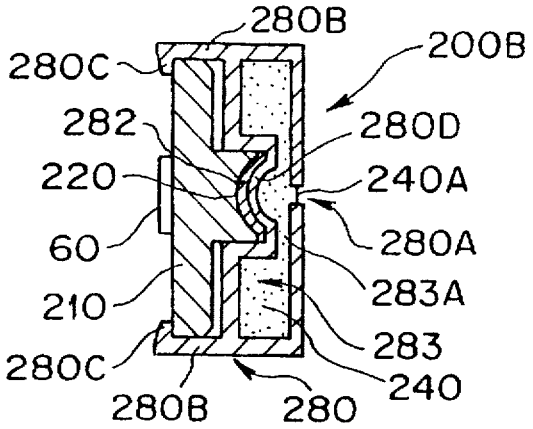
FIGS. 31 to 33 are cross sectional views showing different modifications to the recording head of FIG. 29 in detail.

Referring first to FIG. 31, the modified recording head is also denoted at 200B and is so structured that the ink cartridge 280 is contacted with the surface of the acoustic cylindrical lens 220 of the acoustic medium 210 without employing the filler 281 shown in FIG. 30. Accordingly, a wall 280D of the ink cartridge 280 adjacent the acoustic medium 210 is formed in a semi-cylindrical configuration such that it extends along the surface of the acoustic cylindrical lens 220.

Also the ink cartridge 280 is mounted in a closely contacting condition with the surface of the acoustic cylindrical lens 220 of the acoustic medium 210, and also in the arrangement shown in FIG. 31, the intermediate layer 282 is interposed between the acoustic medium 210 and the ink cartridge 280.

The intermediate layer 282 is formed, quite similarly to that described hereinabove with reference to FIG. 30, from a resilient material such as a rubber member so as to have an intermediate acoustic impedance Zm between the acoustic impedance $Z_1$ of the acoustic medium 210 side and the acoustic impedance $Z_2$of the ink cartridge 280 side (for example, $Z_m=(Z_1 \cdot Z_2)^{1/2}$) Furthermore, the intermediate layer 282 is formed such that it has a thickness set equal to an odd number of times the quarter wavelength of ultrasonic waves emitted from the acoustic cylindrical lens 220, usually to the thickness equal to the quarter wavelength.

It is to be noted that, also in this instance, the intermediate layer 282 may be adhered to the acoustic medium 210 side or to the ink cartridge 280 side.

Figure 32:
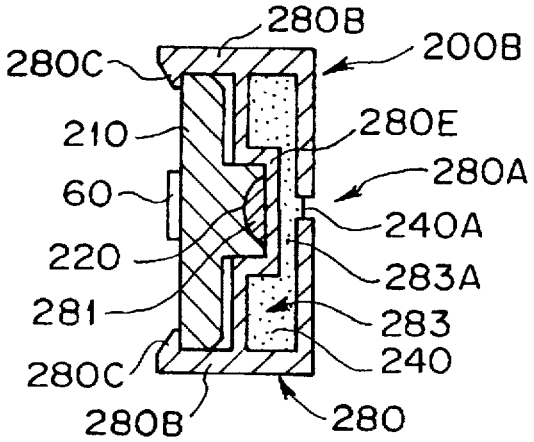

Meanwhile, the modified recording head shown in FIG. 32 is also denoted at 200B and is so structured that the intermediate layer 282 shown in FIG. 30 is not provided and a wall 280E in the form of a flat face of the ink cartridge 280 is closely contacted directly with the filler 281 filled in the acoustic cylindrical lens 220 of the acoustic medium 210. In this instance, also the wall 280E of the ink cartridge 280 has the function required for the intermediate layer 282 described hereinabove.

In particular, the wall 280E of the ink cartridge 280 is formed so as to have an intermediate acoustic impedance $Z_m$ between the acoustic impedance $Z_1$ of the acoustic medium 210 side and the acoustic impedance $Z_3$ of the ink 240 (for example, $Z_m=(Z_1 \cdot Z_3)^{1/2}$). The intermediate layer 282 has a thickness set equal to an odd number of times the quarter wavelength of ultrasonic waves emitted from the acoustic cylindrical lens 220, usually to the thickness equal to the quarter wavelength.

Figure 33:
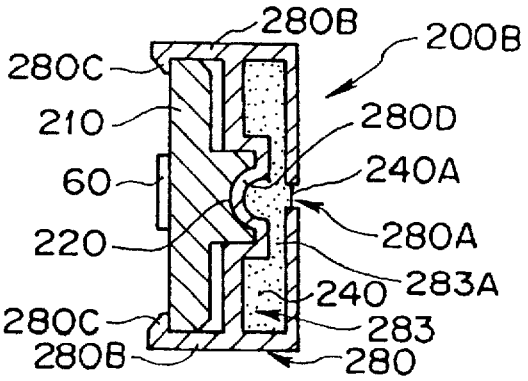

Further, the modified recording head shown in FIG. 33 is also denoted at 200B and is so structured that the intermediate layer 282 shown in FIG. 31 is not provided and a semi-cylindrical wall 280D of the ink cartridge 280 is closely contacted directly with the surface of the acoustic cylindrical lens 220 of the acoustic medium 210. Also in this instance, the wall 280D of the ink cartridge 280 has the function required for the intermediate layer 282 described hereinabove. Further, the wall 280D is set in a similar manner to the wall 280E of the ink cartridge 280.

Also with the recording heads 200B shown in FIGS. 31 to 33 and having the constructions described above, quite similar advantages to those of the recording head 200B described hereinabove with reference to FIG. 30 can be achieved.

It is to be noted that any of the recording heads 200B which are constructed such that such an ink cartridge 280 as described above is removably mounted on the acoustic medium 210 can be applied not only to ultrasonic printing of the phased array type but also similarly to ultrasonic printing, for example, of the type shown in FIGS. 45 and 46 wherein one dot is recorded by one ultrasonic oscillator, and similar advantages to those described above can be achieved. It is to be noted, however, that the opening is not formed as a slit but as a pinpoint-like hole of a small diameter which exposes an ink level including a converging point of ultrasonic waves.

Further, while the arrangements described hereinabove are constructed such that the ink cartridge 280 is mounted on the acoustic medium 210 by means of the pawl portions 280C, any technique may be applied for such mounting only if the ink cartridge 280 can be removably mounted on the acoustic medium 210. For example, a screw or a like element may be used to mount and secure the ink cartridge 280.

Further, while, in the ultrasonic printer 100 of the present embodiment described above with reference to FIGS. 1 to 33, the acoustic cylindrical lens 220 is formed as an acoustic lens on the acoustic medium 210, the acoustic lens which can be applied in the present invention is not limited to the specific lens, and various acoustic lenses such as, for example, a spherical acoustic lens or an acoustic Fresnel lens may be employed for the acoustic lens. Whatever acoustic lens is employed, similar advantages to those of the embodiment described above can be achieved.

Now, several methods of forming various acoustic lenses (elements which converge acoustic waves having been transmitted in an acoustic medium to a predetermined converging point) on an acoustic medium of a recording head of such an acoustic printer as described above will be described with reference to FIGS. 34 to 44.

Whereas an acoustic lens is usually formed by etching, according to the acoustic lens formation method of the present invention, basically an excimer laser beam is irradiated upon an acoustic medium to form an acoustic lens on the acoustic medium.

Figure 34:
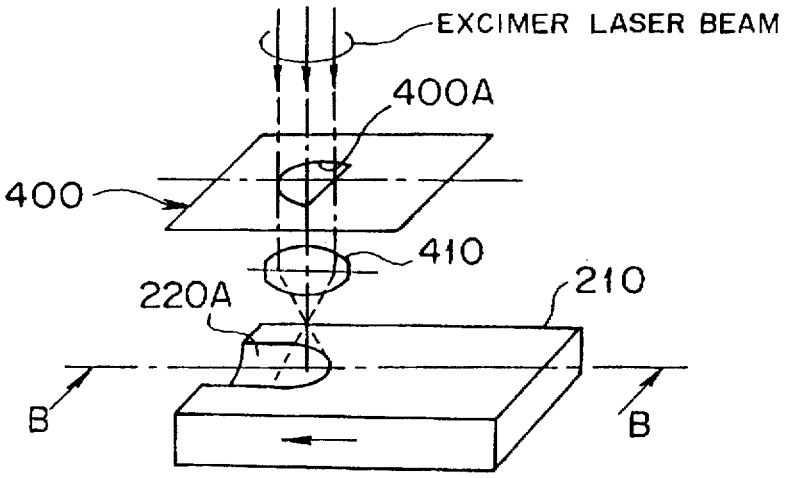
FIG. 34 is a schematic perspective view illustrating a method of forming an acoustic cylindrical lens on an acoustic medium to which the present invention is applied.

FIG. 34 is a schematic perspective view illustrating a method of forming an acoustic cylindrical lens 220 in the form of a cylindrical acoustic lens having a cylindrical concave face described above on an acoustic medium 210 (for example, a substrate material such as aluminum, a work).

As seen in FIG. 34, when the acoustic cylindrical lens 220 is to be formed on the acoustic medium 210, a mask 400 having an opening 400A of a profile having a dimension equal to a fixed number of times that of the cross section of the acoustic cylindrical lens 220 to be formed with regard to the depthwise direction is prepared in advance, and while an excimer laser beam emitted from a light source not shown is irradiated upon the acoustic medium 210 through the opening 400A of the mask 400, the acoustic medium 210 is moved in a predetermined direction at a fixed speed relative to the mask 400.

It is to be noted that, in the example shown in FIG. 34, the acoustic medium 210 is moved in the leftward direction in FIG. 34 with respect to the mask 400 by a transport mechanism or the like not shown. Further, the excimer laser beam having passed through the opening 400A of the mask 400 is condensed by an optical lens 410 and irradiated upon the acoustic medium 210.

Figure 35:
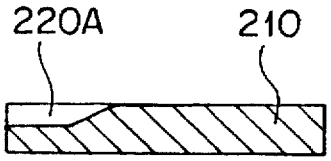
FIG. 35 is a sectional view taken along line B—B of FIG. 34.
Figure 36:
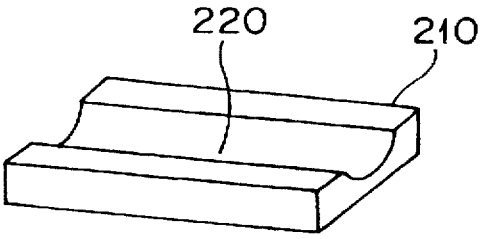
FIG. 36 is a perspective view showing an acoustic medium on which an acoustic cylindrical lens is formed by the method illustrated in FIG.34.

By irradiating the excimer laser beam on the acoustic medium 210 through the mask 400 while moving the acoustic medium 210, a recess 220A having a surface having a substantially arcuate shape (accurately in an elliptic shape) in cross section is formed on the acoustic medium 210 such that it extends along the lengthwise direction of the acoustic medium 210 as seen in FIGS. 35 and 36. Consequently, such an acoustic cylindrical lens 220 for a linear array head as shown in FIG. 36 is formed on the acoustic medium 210.

The acoustic cylindrical lens 220 formed in this manner has a very accurate smooth arcuate cross section.

Further, where an excimer laser beam and the mask 400 having the opening 400A of a predetermined shape are used as described above, not only the cross sectional shape of the acoustic lens can be designed and formed freely, but also the number of working steps is reduced comparing with that where an acoustic lens is formed otherwise by etching. Further, since formation of the acoustic lens can be performed continuously while moving the work (acoustic medium 210), the acoustic lens can be worked with a much improved efficiency.

Further, while the substrate material for the acoustic medium 210 is usually limited to a material which can be etched, where an excimer laser beam is employed, various materials such as plastic materials, metal materials, ceramic materials and glass materials can be employed as a material for an acoustic lens which is an object of working.

Figure 37:
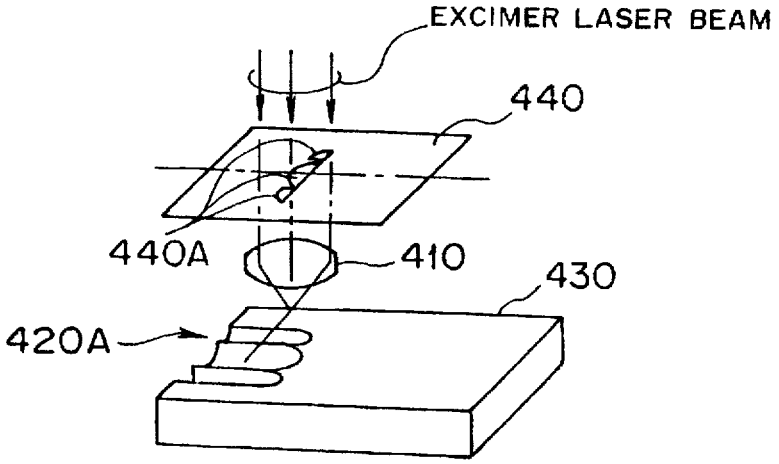
FIG. 37 is a schematic perspective view illustrating a method of forming an acoustic Fresnel lens for a linear array head on an acoustic medium to which the present invention is applied.

FIG. 37 is a schematic perspective view illustrating a method of forming an acoustic Fresnel lens 420 for a linear array head on an acoustic medium (substrate material such as, for example, aluminum, a work) 430.

Referring to FIG. 37, when the acoustic Fresnel lens 420 is to be formed on the acoustic medium 430, similarly as in the example of FIG. 34, a mask 440 having an opening 440A having a shape of a size equal to a fixed number of times that of the cross section of the acoustic Fresnel lens 420 to be formed with regard to the depthwise direction is prepared in advance, and while an excimer laser beam is irradiated upon the acoustic medium 430 through the opening 440A of the mask 440, the acoustic medium 430 is moved at a fixed speed in a predetermined direction relative to the mask 440.

It is to be noted that, also in the example shown in FIG. 37, the acoustic medium 430 is moved in the leftward direction in FIG. 37 with respect to the mask 440 by a transport mechanism or the like not shown. Further, the excimer laser beam having passed through the opening 440A of the mask 440 is condensed by the optical lens 410 and irradiated upon the acoustic medium 430.

Figure 38:
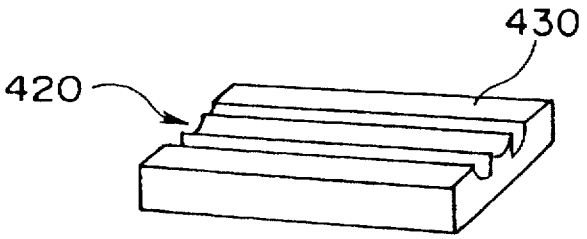
FIG. 38 is a perspective view showing an acoustic medium on which an acoustic cylindrical lens is formed by the method illustrated in FIG. 37.

By irradiating an excimer laser beam upon the acoustic medium 430 through the mask 440 while moving the acoustic medium 430 as described above, a recess 420A having a plurality of surfaces each having a substantially arcuate cross section is formed at a time on the acoustic medium 430 such that it extends along the lengthwise direction of the acoustic medium 430. Consequently, such an acoustic Fresnel lens 420 for a linear array head as shown in FIG. 38 is formed on the acoustic medium 430.

Also the acoustic Fresnel lens 420 formed in this manner has a very accurate and smooth arcuate cross section. The method of the present invention which employs an excimer laser beam is suitable particularly for formation of the acoustic Fresnel lens 420 having a shallow working depth.

Figure 39:
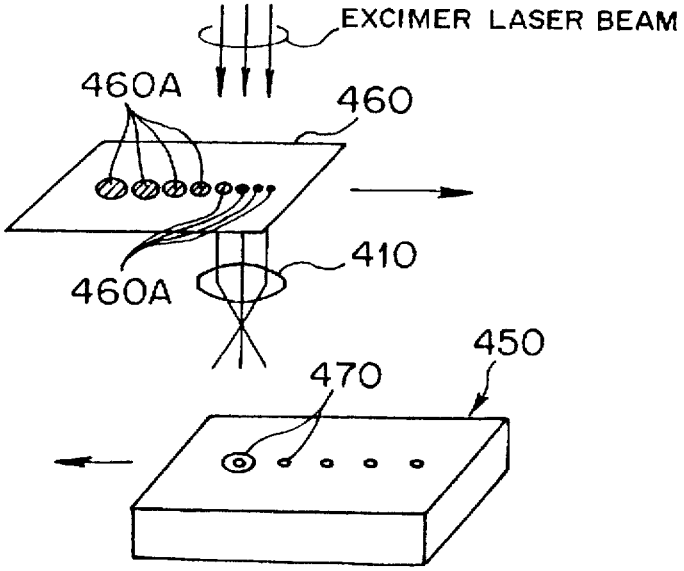
FIG. 39 is a schematic perspective view illustrating a method of forming a single spherical acoustic lens on an acoustic medium to which the present invention is applied.

FIG. 39 is a schematic perspective view illustrating a method of forming a single spherical acoustic lens on an acoustic medium (substrate material such as, for example, aluminum, a work) 450.

As seen in FIG. 39, when a spherical acoustic lens having a spherical concave face is to be formed as an acoustic lens on the acoustic medium 450, a mask 460 (refer to FIG. 40) having a plurality of (8 in the arrangement shown in FIG. 40) openings 460A having different diameters from each other in accordance with an outer diameter and a depth of the spherical acoustic lens to be formed is prepared in advance, and for each of the openings 460A of the mask 460, an excimer laser beam is successively irradiated upon the acoustic medium 450 through the opening 460A.

Figure 40:
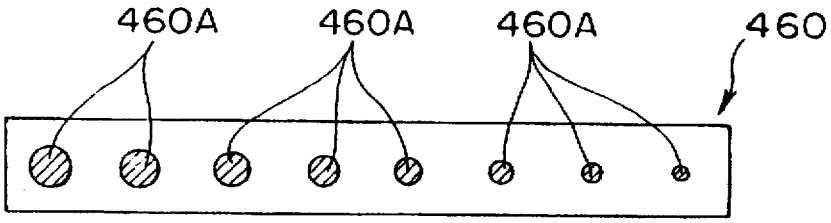
FIG. 40 is a plan view showing an example of a mask for use with the method illustrated in FIG. 39.

It is to be noted that, as seen in FIGS. 39 and 40, on the mask 460, the openings 460A having diameters corresponding to spherical profiles at different depths of the spherical acoustic lens are formed successively in order of the magnitude in diameter. Further, also in the example shown in FIG. 39, the excimer laser beam having passed through an opening 460A is condensed by the optical lens 410 and irradiated upon the acoustic medium 450. In FIGS. 39 and 40, the openings 460A of the mask 460 are indicated by slanting lines.

Then, in the example shown in FIG. 39, the excimer laser beam is first irradiated upon the acoustic medium 450 through one of the openings 460A which has a diameter corresponding to the spherical profile at the deepest position. Thereafter, the mask 460 and the acoustic medium 450 are moved in opposite directions to each other (in an arrangement direction of the openings 460A of the mask 460), and they are successively positioned (centered) each for one of the openings 460A which has a next greater diameter, whereupon the excimer laser beam is irradiated upon the acoustic medium 450 through the thus positioned opening 460A.

Consequently, a recess 470 is gradually formed on the acoustic medium 450 until a spherical acoustic lens having a stepped or stair-case like surface is finally formed on the acoustic medium 450.

Figure 41:
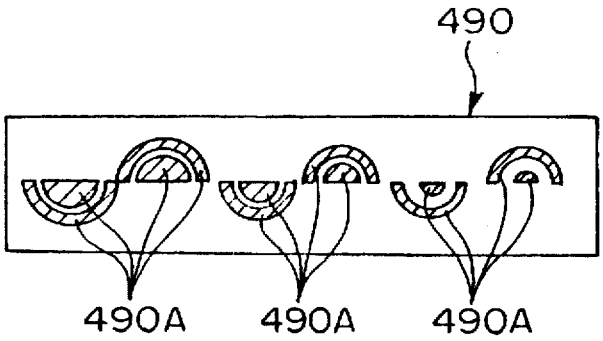
FIG. 41 is a plan view showing an example of a mask for use to form a single acoustic Fresnel lens on an acoustic medium.
Figure 42:
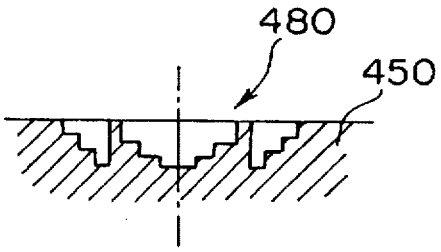
FIG. 42 is a schematic enlarged sectional view showing an acoustic Fresnel lens formed using the mask shown in FIG. 41.

FIG. 41 is a plan view showing an example of a mask 490 which is used to form a single acoustic Fresnel lens (refer to reference numeral 480 in FIG. 42 which shows a cross section of the acoustic Fresnel lens) which can exhibit a same function as a spherical acoustic lens on an acoustic medium (refer to reference numeral 450 in FIG. 42; a substrate material such as, for example, aluminum, a work).

When a single acoustic Fresnel lens is to be formed as an acoustic lens on an acoustic medium, such a mask 490 as shown in FIG. 41 is used in place of the mask 460 which is employed to form the single spherical acoustic lens described hereinabove with reference to FIG. 39. Except that the mask 490 of the type described above is employed, the single acoustic Fresnel lens 480 can be formed on the acoustic medium 450 as shown in FIG. 42 by a quite similar procedure to that employed to form the single spherical acoustic lens described hereinabove with reference to FIG. 39.

It is to be noted that, in the mask 490, a plurality of concentrical slits having different diameters based on the outer diameter of the acoustic Fresnel lens 480 to be formed are formed as openings 490A individually for left and right halves. Here, each ring of the acoustic Fresnel lens 480 is formed as double rings, and if openings are formed in this condition, then a central portion of the mask will drop. Therefore, in the present example, the openings 490A are formed for individual half circles in the mask 490. It is to be noted that the openings 490A of the mask 490 are indicated by slanting lines in FIG. 41.

Figure 43:
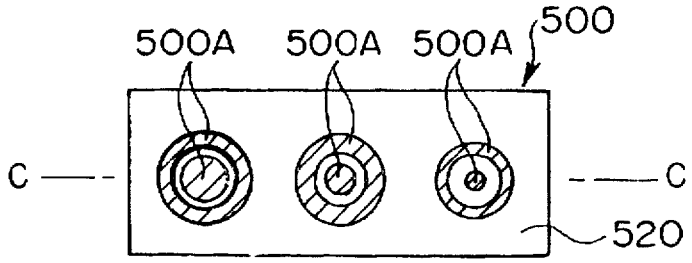
FIG. 43 is a plan view showing another example of the mask for use to form an acoustic Fresnel lens on an acoustic medium.
Figure 44:
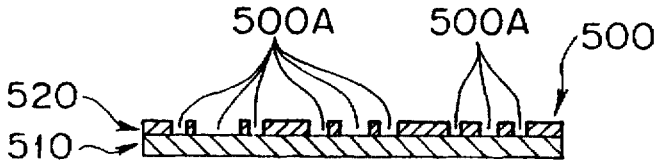
FIG. 44 is a schematic enlarged sectional view taken along line C—C of FIG. 43.

FIGS. 43 and 44 show another mask 500 which is used to form the acoustic Fresnel lens 480 on the acoustic medium 450.

Referring to FIGS. 43 and 44, the mask 500 includes a glass plate 510 and a mask member 520. The glass plate (light passing member) 510 passes light of a wavelength of an excimer laser beam therethrough and is covered with the mask member 520 except such slits as described hereinabove so as to form a plurality of openings 500A. It is to be noted that the openings 500A of the mask 500 are indicated by slanting lines in FIG. 43.

It is to be noted that, with the present mask 500, since the mask member 520 is disposed on the glass plate 510, central portions of the slits will not drop as different from another mask in which openings are formed simply.

Also where the mask 500 described above is employed, such an acoustic Fresnel lens 480 as shown in FIG. 42 can be formed on the acoustic medium 450 by a similar procedure to that described hereinabove with reference to FIG. 39.

In this manner, with the forming methods of an acoustic lens in the present embodiment, by employing an excimer laser beam, various acoustic lenses such as the acoustic cylindrical lens 220, the acoustic Fresnel lens 420, the spherical acoustic lens and the acoustic Fresnel lens 480 can be formed verily readily comparing with the forming method wherein an acoustic lens is formed by etching.

Further, since the formation processing of an acoustic lens can be automated, the production cost for an acoustic lens can be reduced remarkably, and the working efficiency for an acoustic lens is improved very much.

The present invention is not limited to the specifically described embodiment, and variations and modifications may be made without departing from the scope of the present invention.

What is claimed is:

1. An ultrasonic printing method of a phased array type wherein some or all of a plurality of ultrasonic oscillators for emitting ultrasonic waves to be irradiated as converging ultrasonic waves upon ink to discharge the ink in the proximity of a converging point of the converging ultrasonic waves as an ink drop to stick to a recording medium to form a dot on the recording medium in order to perform recording on the recording medium are selectively driven, in order to discharge the ink, in two or more phases different from each other so that the ultrasonic waves emitted from the selected ultrasonic oscillators are converged to a predetermined point, comprising the steps of:

selectively driving some or all of said ultrasonic oscillators such that a difference in phase at the predetermined point between a reference ultrasonic wave from one of the selected ultrasonic oscillators and another ultrasonic wave from any other one of the selected ultrasonic oscillators is equal to or less than one one-fourth of a wavelength of the ultrasonic waves in a transmission medium for the ultrasonic waves from the selected ultrasonic oscillators to the predetermined point.

2. The ultrasonic printing method as claimed in claim 1, wherein any one of the selected ultrasonic oscillators is not driven when a difference in phase at the predetermined point between an ultrasonic wave emitted from an end portion of an ultrasonic oscillation face of the ultrasonic oscillator and the reference ultrasonic wave is equal to or greater than one-fourth of the wavelength of the ultrasonic waves.

3. An ultrasonic printing apparatus of a phased array type, comprising:

a plurality of ultrasonic oscillators for emitting ultrasonic waves to be irradiated as converging ultrasonic waves upon ink to discharge the ink in the proximity of a converging point of the converging ultrasonic waves as an ink drop to stick to a recording medium to form a dot on the recording medium in order to perform recording on the recording medium; and a control circuit for controlling said ultrasonic oscillators to be selectively driven, in order to discharge the ink, in two or more different phases so that the ultrasonic waves emitted from the selected ultrasonic oscillators are converged to a predetermined point;

said control circuit controlling said ultrasonic oscillators so that some or all of said ultrasonic oscillators are selectively driven in such phases that a difference in phase at the predetermined point between a reference ultrasonic wave from one of the selected ultrasonic oscillators and another ultrasonic wave from any other one of the selected ultrasonic oscillators is equal to or less than one-fourth of a wavelength of the ultrasonic waves in a transmission medium for the ultrasonic waves from the selected ultrasonic oscillators to the predetermined point.

4. The ultrasonic printing apparatus as claimed in claim 3, wherein said control circuit controls said ultrasonic oscillators such that any one of the selected ultrasonic oscillators is not driven when a difference in phase at the predetermined point between an ultrasonic wave emitted from an end portion of an ultrasonic oscillation face of the ultrasonic oscillator and the reference ultrasonic wave is equal to or greater than one-fourth of the wavelength of the ultrasonic waves.

5. The ultrasonic printing apparatus as claimed in claim 3, further comprising a storage section for storing in advance information regarding ones of said ultrasonic oscillators which are to be driven at a time so as to converge ultrasonic waves to the predetermined point and information regarding phases of the ultrasonic oscillators to be driven then as a driving pattern, said control circuit being operable, when ink is to be discharged, to read out one of the driving patterns based on a position of a point to which ultrasonic waves are to be converged from said storage section and output the thus read out driving pattern as a serial signal, a shift register for successively shifting the serial signal from said control circuit to store the driving pattern for use to discharge the ink, a latch circuit for receiving and temporarily storing the driving pattern transferred thereto from said shift register, and driving circuit for selectively outputting signals of predetermined phases to the ultrasonic oscillators to be driven at a time in response to the driving pattern stored in said latch circuit so that the ultrasonic oscillators to be driven at a time are driven with the respective predetermined phases.

6. The ultrasonic printing apparatus as claimed in claim 4, further comprising a storage section for storing in advance information regarding ones of said ultrasonic oscillators which are to be driven at a time so as to converge ultrasonic waves to the predetermined point and information regarding phases of the ultrasonic oscillators to be driven then as a driving pattern, said control circuit being operable, when ink is to be discharged, to read out one of the driving patterns based on a position of a point to which ultrasonic waves are to be converged from said storage section and output the thus read out driving pattern as a serial signal, a shift register for successively shifting the serial signal from said control circuit to store the driving pattern for use to discharge the ink, a latch circuit for receiving and temporarily storing the driving pattern transferred thereto from said shift register, and a driving circuit for selectively outputting signals of predetermined phases to the ultrasonic oscillators to be driven at at time in response to the driving pattern stored in said latch circuit so that the ultrasonic oscillators to be driven at a time are driven with the respective predetermined phases.

7. An ultrasonic printing method wherein an ultrasonic wave to be irradiated as a converging ultrasonic wave upon ink is emitted to discharge the ink in the proximity of a converging point of the converging ultrasonic wave as an ink drop to stick to a recording medium to form a dot on the recording medium in order to perform recording on the recording medium, comprising the step of:

varying a frequency of the converging ultrasonic wave with respect to time within a predetermined frequency range centered at a standard resonance frequency.

8. The ultrasonic printing method as claimed in claim 7, wherein a time required for variation of the frequency of the converging ultrasonic wave within the predetermined frequency range is varied.

9. An ultrasonic printing apparatus, comprising:

at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium: and a control circuit for controlling said ultrasonic oscillator so that a frequency of the converging ultrasonic wave to be emitted from said ultrasonic oscillator is varied with respect to time within a predetermined frequency range centered at a standard resonance frequency.

10. The ultrasonic printing apparatus as claimed in claim 9, wherein said control circuit is capable of varying a time required for variation of the frequency of the converging ultrasonic wave to be emitted from said ultrasonic oscillator within the predetermined frequency range.

11. An ultrasonic printing apparatus, comprising:

means for transporting a recording medium in a transportation direction; and a recording head having a plurality of ultrasonic oscillators arranged in a straight line thereon for emitting ultrasonic waves to be irradiated as converging ultrasonic waves upon ink to discharge the ink in the proximity of a converging point of the converging ultrasonic waves as an ink drop to stick to a recording medium to form a dot on the recording medium in order to perform recording on the recording medium;

said recording head being disposed such that a direction in which said ultrasonic oscillators are arranged is inclined by a predetermined angle with respect to a direction of a line of dots to be formed perpendicular to the transportation direction of the recording medium.

12. The ultrasonic printing apparatus as claimed in claim 11, further comprising a control circuit for controlling said ultrasonic oscillators of said recording head such that some or all of said ultrasonic oscillators are driven at a time to discharge a plurality of ink drops at a time from said recording head to form a plurality of dots, which do not interfere with each other, at a time on the recording medium.

13. The ultrasonic printing apparatus as claimed in claim 12, wherein said control circuit controls said ultrasonic oscillators so that ink drops to form dots in a same dot column are successively discharged to the recording medium, which is transported at a fixed speed, at time intervals equal to a value obtained by multiplying a number of dots based on a distance between dots to be formed at a time by a discharging period of ink drops.

14. An ultrasonic printing method wherein an ultrasonic wave to be irradiated as a converging ultrasonic wave upon ink is emitted to discharge the ink in the proximity of a converging point of the converging ultrasonic wave as an ink drop to stick to a recording medium to form a dot on the recording medium in order to perform recording on the recording medium, comprising the step of:

emitting, after discharging of each ink drop, at a same ink drop discharging position as that in the last ink drop discharging operation when a position of a level of the ink becomes lower than a position of the ink level in a stable condition of the ink level due to residual oscillations of the ink level, a converging ultrasonic wave having energy insufficient to discharge an ink drop to the ink.

15. An ultrasonic printing method wherein an ultrasonic wave to be irradiated as a converging ultrasonic wave upon ink is emitted to discharge the ink in the proximity of a converging point of the converging ultrasonic wave as an ink drop to stick to a recording medium to form a dot on the recording medium in order to perform recording on the recording medium, comprising the step of:

emitting, when a next ink drop is to be discharged, immediately after discharging of an ink drop, successively for the same dot, a converging ultrasonic wave having energy based on a position of a level of the ink which is moved by residual oscillations of the ink level to the ink.

16. The ultrasonic printing method as claimed in claim 15, wherein, when the position of the ink level is higher than a position of the ink level in a stable condition of the ink level, a converging ultrasonic wave having energy lower than energy to be applied to the ink level in a stable condition of the ink level is emitted to the ink.

17. The ultrasonic printing method as claimed in claim 15, wherein, when the position of the ink level is lower than a position of the ink level in a stable condition of the ink level, a converging ultrasonic wave having energy higher than energy to be applied to the ink level in a stable condition of the ink level is emitted to the ink.

18. The ultrasonic printing method as claimed in claim 15, wherein the energy based on the position of the ink level is controlled by a voltage to be applied to an ultrasonic oscillator from which the ultrasonic wave is to be emitted.

19. The ultrasonic printing method as claimed in claim 16, wherein the energy based on the position of the ink level is controlled by a voltage to be applied to an ultrasonic oscillator from which the ultrasonic wave is to be emitted.

20. The ultrasonic printing method as claimed in claim 17, wherein the energy based on the position of the ink level is controlled by a voltage to be applied to an ultrasonic oscillator from which the ultrasonic wave is to be emitted.

21. The ultrasonic printing method as claimed in claim 15, wherein the energy based on the position of the ink level is controlled by an emission time of the ultrasonic wave.

22. The ultrasonic printing method as claimed in claim 16, wherein the energy based on the position of the ink level is controlled by an emission time of the ultrasonic wave.

23. The ultrasonic printing method as claimed in claim 17, wherein the energy based on the position of the ink level is controlled by an emission time of the ultrasonic wave.

24. An ultrasonic printing apparatus, comprising:

at least one ultrasonic oscillator for being driven to emit an ultrasonic wave to be irradiated as converging ultrasonic wave upon ink to discharge the ink in the proximity of a converging point of the converging ultrasonic wave as an ink drop to stick to a recording medium to form a dot on the recording medium in order to perform recording on the recording medium; and a control circuit for controlling a driving condition of said ultrasonic oscillator so that said ultrasonic oscillator emits, after discharging of each ink drop, at a same ink drop discharging position as that in the last ink drop discharging operation when a position of a level of the ink becomes lower than a position of the ink level in a stable condition of the ink level due to residual oscillations of the ink level, a converging ultrasonic wave having energy insufficient to discharge an ink drop to the ink.

25. An ultrasonic printing apparatus, comprising:

at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium; and a control circuit for controlling a driving condition of said ultrasonic oscillator so that said ultrasonic oscillator emits, when a next ink drop is to be discharged, immediately after discharging of an ink drop, successively for the same dot, a converging ultrasonic wave having energy based on a position of a level of the ink which is moved by residual oscillations of the ink level to the ink.

26. The ultrasonic printing apparatus as claimed in claim 25, wherein said control circuit controls the driving condition of said ultrasonic oscillator so that, when the position of the ink level is higher than a position of the ink level in a stable condition of the ink level, a converging ultrasonic wave having energy lower than energy to be applied to the ink level in a stable condition of the ink level is emitted to the ink.

27. The ultrasonic printing apparatus as claimed in claim 25, wherein said control circuit controls the driving condition of said ultrasonic oscillator so that, when the position of the ink level is lower than a position of the ink level in a stable condition of the ink level, a converging ultrasonic wave having energy higher than energy to be applied to the ink level in a stable condition of the ink level is emitted to the ink.

28. The ultrasonic printing apparatus as claimed in claim 25, wherein said control circuit controls the energy based on the position of the ink level by a voltage to be applied to said ultrasonic oscillator.

29. The ultrasonic printing apparatus as claimed in claim 26, wherein said control circuit controls the energy based on the position of the ink level by a voltage to be applied to said ultrasonic oscillator.

30. The ultrasonic printing apparatus as claimed in claim 27, wherein said control circuit controls the energy based on the position of the ink level by a voltage to be applied to said ultrasonic oscillator.

31. The ultrasonic printing apparatus as claimed in claim 25, wherein said control circuit controls the energy based on the position of the ink level by an emission time of the ultrasonic wave from said ultrasonic oscillator.

32. The ultrasonic printing apparatus as claimed in claim 26, wherein said control circuit controls the energy based on the position of the ink level by an emission time of the ultrasonic wave from said ultrasonic oscillator.

33. The ultrasonic printing apparatus as claimed in claim 27, wherein said control circuit controls the energy based on the position of the ink level by an emission time of the ultrasonic wave from said ultrasonic oscillator.

34. An ultrasonic printing apparatus, comprising:

at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium;

magnetized ink being used as the ink;

means defining an opening in which a level of the ink is positioned and from which an ink dot is to be discharged; and a magnetic field generation section for generating a magnetic field in said opening.

35. The ultrasonic printing apparatus as claimed in claim 34, wherein said magnetic field generation section includes a pair of permanent magnets disposed with different magnetic poles opposed to each other across said opening.

36. The ultrasonic printing apparatus as claimed in claim 35, further comprising an electromagnet provided for said permanent magnets, and a control circuit for controlling an energization condition of said electromagnet so that said electromagnet forms a magnetic field which is capable of cancelling the magnetic field formed by said permanent magnets when an ink drop is to be discharged or upon ink removing operation.

37. The ultrasonic printing apparatus as claimed in claim 34, wherein said magnetic field generation section includes a pair of electromagnets disposed in an opposing relationship to each other across said opening, and further comprising a control circuit for controlling energization conditions of said electromagnets.

38. The ultrasonic printing apparatus as claimed in claim 37, wherein said control circuit controls the energization conditions of said electromagnets so that a height of the ink level in said opening is adjusted by an intensity of a magnetic field formed by producing different magnetic poles in said electromagnets.

39. The ultrasonic printing apparatus as claimed in claim 37, wherein said control circuit cancels the energization conditions of said electromagnets when an ink drop is to be discharged or upon ink removing operation.

40. The ultrasonic printing apparatus as claimed in claim 38, wherein said control circuit cancels the energization conditions of said electromagnets when an ink drop is to be discharged or upon ink removing operation.

41. The ultrasonic printing apparatus as claimed in claim 37, wherein said control circuit controls the energization conditions of said electromagnets so that, upon ink removing operation, said electromagnets generate magnetic fields which repel each other.

42. The ultrasonic printing apparatus as claimed in claim 38, wherein said control circuit controls the energization conditions of said electromagnets so that, upon ink removing operation, said electromagnets generate magnetic fields which repel each other.

43. An ultrasonic printing apparatus, comprising:

at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium;

electro-viscous ink being used as the ink;

means defining an opening in which a level of the ink is positioned and from which an ink drop is to be discharged; and an electric field generation section for generating an electric field in said opening.

44. The ultrasonic printing apparatus as claimed in claim 43, wherein said electric field generation section includes a pair of electrodes disposed in an opposing relationship to each other across said opening, and further comprising a control circuit for controlling energization conditions of said electromagnets.

45. The ultrasonic printing apparatus as claimed in claim 44, wherein said control circuit controls the energization conditions of said electrodes so that a height of the ink level in said opening is adjusted by a potential difference produced between said electrodes.

46. The ultrasonic printing apparatus as claimed in claim 44, wherein said control circuit cancels the energization conditions of said electrodes when an ink drop is to be discharged or upon ink removing operation.

47. The ultrasonic printing apparatus as claimed in claim 45, wherein said control circuit cancels the energization conditions of said electrodes when an ink drop is to be discharged or upon ink removing operation.

48. An ultrasonic printing apparatus, comprising:

at least one ultrasonic oscillator for being driven to emit an ultrasonic wave to be irradiated as a converging ultrasonic wave upon ink to discharge the ink in the proximity of a converging point of the converging ultrasonic wave as an ink drop to stick to a recording medium to form a dot on the recording medium in order to perform recording on the recording medium;

an acoustic medium having an acoustic lens formed thereon for converging the ultrasonic wave from said ultrasonic oscillator into a converging ultrasonic wave; and an ink cartridge containing the ink therein and having an opening formed therein in which a level of the ink is formed and from which an ink drop can be discharged to the outside;

said ink cartridge being removably mounted on said acoustic medium.

49. The ultrasonic printing apparatus as claimed in claim 48, wherein said acoustic lens is filled with a filler, and a surface of said acoustic medium adjacent said ink cartridge is formed as a flat face such that said ink cartridge is mounted in a closely contacting condition on the surface in the form of a flat face of said acoustic medium adjacent said ink cartridge.

50. The ultrasonic printing apparatus as claimed in claim 48, wherein said ink cartridge is mounted in a closely contacting condition with a surface of said acoustic lens of said acoustic medium.

51. The ultrasonic printing apparatus as claimed in claim 48, further comprising an intermediate layer interposed between said acoustic medium and said ink cartridge.

52. The ultrasonic printing apparatus as claimed in claim 49, further comprising an intermediate layer interposed between said acoustic medium and said ink cartridge.

53. The ultrasonic printing apparatus as claimed in claim 50, further comprising an intermediate layer interposed between said acoustic medium and said ink cartridge.

54. The ultrasonic printing apparatus as claimed in claim 51, wherein said intermediate layer is a resilient member.

55. The ultrasonic printing apparatus as claimed in claim 52, wherein said intermediate layer is a resilient member.

56. The ultrasonic printing apparatus as claimed in claim 53, wherein said intermediate layer is a resilient member.

57. The ultrasonic printing apparatus as claimed in claim 51, wherein said intermediate layer has an intermediate acoustic impedance between an acoustic impedance of said acoustic medium and an acoustic impedance of said ink cartridge.

58. The ultrasonic printing apparatus as claimed in claim 52, wherein said intermediate layer has an intermediate acoustic impedance between an acoustic impedance of said acoustic medium and an acoustic impedance of said ink cartridge.

59. The ultrasonic printing apparatus as claimed in claim 53, wherein said intermediate layer has an intermediate acoustic impedance between an acoustic impedance of said acoustic medium and an acoustic impedance of said ink cartridge.

60. The ultrasonic printing apparatus as claimed in claim 51, wherein said intermediate layer has a thickness equal to an odd number of times a quarter wavelength of the ultrasonic wave to be emitted from said acoustic lens.

61. The ultrasonic printing apparatus as claimed in claim 52, wherein said intermediate layer has a thickness equal to an odd number of times a quarter wavelength of the ultrasonic wave to be emitted from said acoustic lens.

62. The ultrasonic printing apparatus as claimed in claim 53, wherein said intermediate layer has a thickness equal to an odd number of times a quarter wavelength of the ultrasonic wave to be emitted from said acoustic lens.

63. The ultrasonic printing apparatus as claimed in claim 48, wherein a wall of said ink cartridge adjacent said acoustic medium has an intermediate acoustic impedance between an acoustic impedance of said acoustic medium and an acoustic impedance of the ink in said ink cartridge.

64. The ultrasonic printing apparatus as claimed in claim 49, wherein a wall of said ink cartridge adjacent said acoustic medium has an intermediate acoustic impedance between an acoustic impedance of said acoustic medium and an acoustic impedance of the ink in said ink cartridge.

65. The ultrasonic printing apparatus as claimed in claim 50, wherein a wall of said ink cartridge adjacent said acoustic medium has an intermediate acoustic impedance between an acoustic impedance of said acoustic medium and an acoustic impedance of the ink in said ink cartridge.

66. A method of forming an acoustic lens, which converges an acoustic wave having been transmitted in an acoustic medium to a predetermined converging point, on the acoustic medium, comprising the step of:

irradiating an excimer laser beam upon the acoustic medium to form the acoustic lens on the acoustic medium.

67. The method of forming an acoustic lens as claimed in claim 66, wherein, when a cylindrical acoustic lens having a cylindrical concave face is to be formed as the acoustic lens on the acoustic medium, a mask having an opening of a profile having a size equal to a multiple of a size of a cross section of the cylindrical acoustic lens to be formed by a fixed value with regard to a depthwise direction of the acoustic lens is prepared in advance, and the excimer laser beam is irradiated upon the acoustic medium through the opening of the mask while at the same time the acoustic medium is moved at a fixed speed in a predetermined direction relative to said mask.

68. The method of forming an acoustic lens as claimed in claim 66, wherein, when a spherical acoustic lens having a spherical concave face is to be formed as the acoustic lens on the acoustic medium, at least one mask having a plurality of circular openings having different diameters from each other based on a diameter and a depth of the spherical acoustic lens to be formed is prepared in advance, and the excimer laser beam is successively irradiated upon the acoustic medium through each of the openings of the mask.

69. The method of forming an acoustic lens as claimed in claim 68, wherein the plurality of openings are formed in a successive arrangement in the mask in advance, and the excimer laser beam is successively irradiated upon the acoustic medium through each of the openings of the mask while the mask is successively moved in a direction of the arrangement of the openings.

70. The method of forming an acoustic lens as claimed in claim 66, wherein, when an acoustic Fresnel lens having an equivalent function to that of a spherical acoustic lens having a spherical concave face is to be formed as the acoustic lens on the acoustic medium, at least one mask having a plurality of concentrical slits having different diameters from each other based on an outer diameter of the acoustic Fresnel lens to be formed is prepared in advance, and the excimer laser beam is successively irradiated upon the acoustic medium through each of the slits of the mask.

71. The method of forming an acoustic lens as claimed in claim 70, wherein each of the slits is formed as a pair of openings for different half circles in the mask.

72. The method of forming an acoustic lens as claimed in claim 70, wherein the slits are formed by covering a light passing member, which passes light of a wavelength of the excimer laser beam, at any location other than portions to form the slits with a mask member.

* * * * *